US005227806A

United States Patent [19]

Eguchi

[11] Patent Number: 5,227,806

[45] Date of Patent: Jul. 13, 1993

[54] STABILIZED SHIP ANTENNA SYSTEM FOR SATELLITE COMMUNICATION

[75] Inventor: Kouichi Eguchi, Mitaka, Japan

[73] Assignee: Japan Radio Co., Ltd., Tokyo, Japan

[21] Appl. No.: 850,887

[22] Filed: Mar. 13, 1992

[30] Foreign Application Priority Data

Mar. 20, 1991 [JP] Japan ..... 3-057070
Nov. 28, 1991 [JP] Japan ..... 3-315020

[51] Int. Cl.[5] ..... H01Q 3/00

[52] U.S. Cl. ..... 343/765; 343/763; 343/766; 342/359

[58] Field of Search ..... 343/765, 763, 766, 878, 343/DIG. 2, 757; 342/359

[56] References Cited

U.S. PATENT DOCUMENTS 2,421,028 5/1947 King ..... 343/765
2,604,698 7/1952 Ewing ..... 343/766
4,675,688 6/1987 Sahara et al. ..... 343/765

FOREIGN PATENT DOCUMENTS 0106178 4/1984 European Pat. Off. .
51-115757 10/1976 Japan .
4-64074 2/1992 Japan .
1002844A 10/1983 U.S.S.R. .
2251982A 7/1992 United Kingdom .

OTHER PUBLICATIONS

Takayasu Shiokawa et al., "Development of a Compact Antenna System for the Inmarsat Standard-B SES in Maritime Satellite Communications", Treatises of Electronic Communications Society, SANE84-19, Aug. 31, 1984, pp. 17-24.

*Primary Examiner*—Rolf Hille
*Assistant Examiner*—Hoanganh Le
*Attorney, Agent, or Firm*—Oliff & Berridge

[57] ABSTRACT

A stabilized antenna system. An inclination angle detector is mounted on an AZ frame and detects an inclination angle around an elevation, and the elevation of the antenna is controlled by a successive addition of the detected inclination angle to simplify control algorithm. Furthermore, the inclination angle detector includes a reciprocal combination filter for combining outputs of an inclinometer and a rate sensor. The reciprocal combination filter includes two reciprocal filters, and parameters of the reciprocal filters are adaptively controlled depending on frequency and amplitude of the inclination to ensure the reciprocity in a necessary frequency range.

8 Claims, 29 Drawing Sheets

STABILIZED SHIP ANTENNA SYSTEM FOR SATELLITE COMMUNICATION

BACKGROUND OF THE INVENTION i) Field of the Invention

The present invention relates to a stabilized antenna system including an antenna having fan beam directivity, that is, a wide beam width around a longitudinal axis of the antenna.

ii) Description of the Related Art

Conventionally, a directive antenna has been used for satellite communication on a ship or the like. The ship satellite communication was started by the MARISAT satellite, of the U.S.A., in 1976, which has been taken over and practiced by an international organization, INMARSAT, since 1982. For conducting such ship satellite communications, an antenna having a certain directivity is required.

For example, according to the technical requirements document for INMARSAT, as of June, 1987, a ship-/earth station the G/T of the ship/earth station is provided with at least −4 dBK, and, in order to construct an antenna satisfying this requirement i.e., as a parabolic antenna, a diameter dimension of approximately 80 cm is demanded.

For ship satellite communication, a stabilized antenna system has been solely used. This stabilized antenna system is provided with a stabilization function in addition to a satellite tracking function.

That is, in order that an antenna mounted on a moving platform, in a ship or the like, can receive a radio wave sent from a satellite, it is necessary to track the satellite by driving the antenna. Such antenna driving and control functions can be constructed so as to carry out the stabilization of the antenna. For instance, the ship is inclined by waves on the sea, and by compensating for this inclination, good satellite tracking can be realized. The inclination parameter of the ship includes, for example, roll, pitch and the like. In order to stabilize the antenna against roll and pitch it is required to drive mechanically or electronically the antenna or its beam direction either sideways or lengthways. Hence, conventionally, a variety of techniques for driving the antenna have been developed.

In FIG. 29, there is shown a conventional stabilized antenna system, as disclosed in Japanese Patent Laid-Open No.Sho 51-115757. This antenna system is formed with a parabolic antenna 10 having pencil beam directivity, and a mount composed of members 12 to 16 for supporting the parabolic antenna 10.

By this mount, the parabolic antenna 10 can be angularly moved around an axis 12, around another axis 14 and also around a further axis 16 at the same time. Since the axis 16 is vertical, by angularly moving the parabolic antenna 10 around the axis 16, an azimuth the parabolic antenna 10 directs to can be controlled. Hence, this axis 16 is usually called an azimuth (AZ) axis.

In this conventional stabilized antenna system, an attitude sensor 18 is arranged on the axis 16 so as to rotate therewith. The attitude sensor 18 detects inclinations around the axes 12 and 14. By applying this detected result to the drive controls of the axes 12 and 14, while the inclinations are compensated for or stabilized, the satellite tracking by the parabolic antenna 10 can be properly performed.

As described above, all of three axes can be formed by mechanical axes. However, in this case, the structural designing becomes complicated, and thus the entire antenna system is apt to be high cost. In order to solve this problem, the axis structure is improved so as to be sufficient with two mechanical axes.

A a two-axis mechanical axis antenna system, for instance, is disclosed in "Development of a Compact Antenna System for INMARSAT Standard-B SEs in Maritime Satellite Communication", Shiokawa et al., Institute of Electronics and Communication Engineers of Japan, SANE 84-19, pp 17–24. In this antenna system, a short backfire antenna of 40 cmϕ, having a beam width of ±15° is used.

On the basis of this structure, a stabilized antenna system can be implemented by a relatively simple mechanical structure.

However, in such a structure, a singular point is caused. The singular point, for instance, appears in the zenith direction, and, when the antenna faces in this direction under the inclined condition, a tracking error is caused. In order to deal with the singular point properly, a light and solid material is used for antenna and support frame construction to reduce a load of a drive motor. Alternatively, a relatively high performance AC servo motor is adopted and accordingly a high performance AC servo control circuit is used to drive the antenna by a high performance servo system. Furthermore, by improving the software, the tracking error near the singular point can be reduced.

However, these countermeasures require a particular material, expensive circuit adoption and the like, and increased cost of the antenna system can not be avoided. Furthermore, even when these countermeasures are applied, a tracking error of approximately 10° is reported at the singular point.

In order to solve such problems, it is effective to use electronic beam steering for any of the axes. The electronic axis can be implemented by a phased array antenna.

The phased array antenna, for example, is formed by arranging a plurality of antenna elements as electrodes in a square lattice formed on an antenna plane. Furthermore, a phase shifter is provided for each antenna element, and by controlling the amount of phase shift of a signal for each antenna element, the beam direction of the antenna can be controlled. Also, as disclosed in Japanese Patent Application No. Hei 2-339317 proposed by the present applicant, by providing a phase shifter for each column of antenna elements arranged in a matrix form, the electronic axis can be implemented by a relatively simple construction.

As described above, by using two mechanical axes and one electronic axis, the singular point can be avoided and the stabilization can be carried out by a relatively simple and inexpensive construction. However, in this stabilization, a two to three axes control is required.

In general, the inclination of a ship is exhibited as a coordinate transformation, as shown in FIG. 30, wherein a coordinate system X(0)Y(0)Z(0) is represented by X(0) in the bow direction, Z(0) in the zenith direction when the ship is not inclined.

In this case, when a pitch occurs, the coordinate system is moved to X(1)Y(1)Z(1).

In turn, when a roll happens, the coordinate system is moved to X(2)Y(2)Z(2).

In FIG. 30, an angle v representing the inclination of the ship can be resolved into a component q1 around the elevation (EL) and a component q2 around the cross elevation (XEL) perpendicular to the EL axis. Each component q1 or q2 can be obtained by a matrix operation on the basis of the roll r or the pitch p.

For instance, when the EL and XEL axes are constructed as the mechanical and electronic axes respectively, the controls of the EL and XEL axes are carried out on the basis of the respective components q1 and q2.

However, this controlling becomes complicated with respect to carrying out the matrix operation. Hence, if the matrix operation can be omitted or eliminated, the construction of the antenna system can be simplified, and an inexpensive stabilized antenna system can be realized. For simplifying the construction and reducing the cost, an antenna system having a fan beam directivity is proposed.

In FIG. 31, there is shown another conventional stabilized antenna system using an array antenna having fan beam directivity. In the stabilized antenna system, as shown in FIG. 31, the array antenna 22 includes four antenna elements 20 aligned longitudinally. The array antenna 22 possesses fan beam directivity, as hereinafter described in detail, and is supported by an EL axis 24 so that the antenna elements may be arranged around the EL axis 24.

The EL axis 24 is rotatably supported by a U-shaped AZ axis frame 26. A gear 28 is mounted to one end of the EL axis 24, and an EL axis motor 30 is mounted to the AZ axis frame 26. A belt 32 is suspended between the gear 28 and the EL axis motor 30. Accordingly, by driving the EL axis motor 30, the EL axis 24 is rotated to turn the array antenna around the EL axis 24.

An AZ axis 34 is integrally secured to the AZ axis frame 26 on its central position and is rotatably held by a pedestal 36 having a T-shaped cross section, and a gear 38 is attached to the lower end of the AZ axis 34. An AZ axis motor 40 is mounted to the pedestal 36, and a belt 42 is extended between the gear 38 and the AZ axis motor 40. Hence, by driving the AZ axis motor 40, the AZ axis 34 is rotated to turn the array antenna 22 around the AZ axis 34.

The pedestal 36 eccentrically supports the AZ axis frame 26, the EL axis 24, the array antenna 22 and the like. That is, the pedestal 36 is mounted on a radome base 44 in an eccentric position from the center of the radome base 44. An access hutch 48 having sufficient size for operation is provided to the radome base 44 through a hinge 46 so as to be openable. The access hutch 48 is formed for an operator to insert his hand through the opened access hutch 48 for carrying out maintenance and inspection of the array antenna 22, it peripheral circuits and the like. As a result, the maintainability of the antenna system can be secured.

The radome base 44 constitutes the bottom part of a radome 50. The radome 50 for protecting the components of the antenna system from rainfall or the like is made of a material such as FRP or the like through which the radio wave can pass.

In FIGS. 32 and 33, there are shown antenna patterns of the array antenna 22 around the virtual XEL axis and the EL axis 24, respectively. The virtual XEL axis is a virtual axis perpendicular to the EL axis 24 and is not actually present in the antenna system shown in FIG. 31.

As apparent from FIGS. 32 and 33, the directivity of the array antenna 22 is wide around the virtual XEL axis and narrow around the EL axis 24. This property is generally called fan beam directivity. By using the fan beam directivity around virtual XEL axis, the stabilization of the component q2 is not required.

However, even in this case using the array antenna having the fan beam directivity, it is necessary to obtain the matrix operation of the component q1 around the EL axis 24, and the calculation for the control is still complicated.

SUMMARY OF THE INVENTION

It is therefore an object of the present invention to provide a stabilized antenna system in view of the problems of the prior art, which is capable of simplifying a calculation for stabilization and which is simple in construction.

In order to achieve the object, a stabilized antenna system according to the present invention comprises:

a) an antenna having a fan beam directivity, mounted on a moving platform;
b) an EL axis for supporting the antenna;
c) an AZ frame for pivotally supporting the EL axis;
d) an AZ axis for supporting the AZ frame;
e) EL axis driving means for controlling the EL axis to steer the antenna around the EL axis;
f) AZ axis driving means for rotating the AZ frame to steer the antenna around the AZ axis;
g) inclination sensing means arranged to rotate together with the AZ frame for detecting an inclination component $q_1$ around the EL axis of an inclination of the moving platform; and
h) control means for controlling a beam direction of the antenna for tracking a satellite and stabilizing the antenna with reference to the inclination of the moving platform, the control means controlling the AZ axis driving means and the EL axis driving means to carry out the tracking of the satellite, and controlling a beam direction of the antenna for compensating against the inclination component $q_1$ to carry out the stabilization of the antenna.

According to the present invention, as constructed above, for example, there is no need to carry out a calculation for the stabilization around a virtual XEL axis, as shown in FIG. 32. This is why the antenna has the fan beam directivity. Hence, it is sufficient only to carry out the stabilization calculation for the inclination component $q_1$ around the EL axis.

Furthermore, according to the present invention, the inclination component $q_1$ can be directly detected by the inclination sensing means. Accordingly, the detection output of the inclination sensing means can be used for the stabilization control, as it is. For example, assuming that the elevation of the satellite is defined e1 with reference to the horizontal plane when no inclination occurs, the beam direction of the antenna can be controlled by using the following control amount with reference to the zenith:

$$\theta = 90^\circ - e1 + q_1$$

Hence, according to the present invention, not only the control algorithm becomes simple, but also, since it is enough to detect the inclination component of only one axis, the inclination sensing means becomes less in cost and light in weight.

Furthermore, the inclination sensing means can preferably include:

a) a rate sensor for detecting an angular velocity around the EL axis;

b) an inclinometer for detecting an inclination around the EL axis; and c) a reciprocal combination filter for combining outputs of the rate sensor and the inclinometer and outputting an inclination component $q_1$, including:

c1) first filter means for filtering the output of the rate sensor;

c2) second filter means having a reciprocal transfer function with reference to the first filter means for filtering the output of the inclinometer; and c3) adding means for combining outputs of the first and second filter means to output the inclination component $q_1$.

In such a construction, a flat frequency characteristic can be obtained in the necessary frequency range for the stabilization. Furthermore, by improving the structure of the reciprocal combination filter, the offset error of the rate sensor and the response error against the inclination (so-called inclination acceleration error) can be reduced.

As to the first improvement, there is an addition of a feedback loop of a feedback gain factor $K_b$. That is, the feedback loop of the feedback gain factor $K_b$ is included in the first filter means. Hence, the feedback gain factor $K_b$ appears in the denominator of a transfer function of the first filter means. As a result, the feedback gain factor $K_b$ also appears in the denominator of the formula expressing the offset error. Hence, by setting the feedback gain factor $K_b$ large, the offset error can be reduced.

Regarding the second improvement, there is provided an adaptive control of the correction factor $\alpha$ ($\alpha \leqq 1$) based on the inclination frequency. If the transfer functions of the first and second filter means are determined so as to satisfy the reciprocity of at least the necessary frequency range, as described above, corresponding to the provision of the feedback loop in the first filter means, a differential term appears in the numerator of the transfer function of the second filter means. This term, of the 1st order of Laplace operator s, emphasizes the error (inclination acceleration error, of the inclinometer caused by accelerations of ship's inclinations. In this improvement, by controlling the influence of the a term of the 1st order Laplace operator s by the correction factor $\alpha$, the inclination acceleration error can be reduced. Furthermore, for this reduction, the inclination frequency is detected and the parameter control of the correction factor $\alpha$ is carried out to reduce the error depending on the inclination conditions.

As regards the third improvement, the inclination amplitude is detected and the adaptive control of the feedback gain factor $K_b$ is carried out. This is based on the fact that by enlarging the feedback gain factor $K_b$, the inclination acceleration error becomes significant.

Furthermore, such an inclination angle sensor, that is, an inclination sensing means including parameter adaptive control means proposed above, is applicable to the stabilized antenna system. In this respect, the structure is the same as described above, and thus the detailed description can be omitted for brevity.

According to the present invention, the stabilization can be performed by controlling the beam direction of the antenna. Relating to the antenna beam direction control means, the means for controlling the elevation of the antenna by the EL axis driving means can be used as well as the means for controlling the beam direction of the antenna.

BRIEF DESCRIPTION OF THE DRAWINGS

The above and other objects, features and advantages of the present invention will more fully appear from the following description of the preferred embodiments with reference to the accompanying drawings, in which.

DESCRIPTION OF THE PREFERRED EMBODIMENTS

Figure 1:
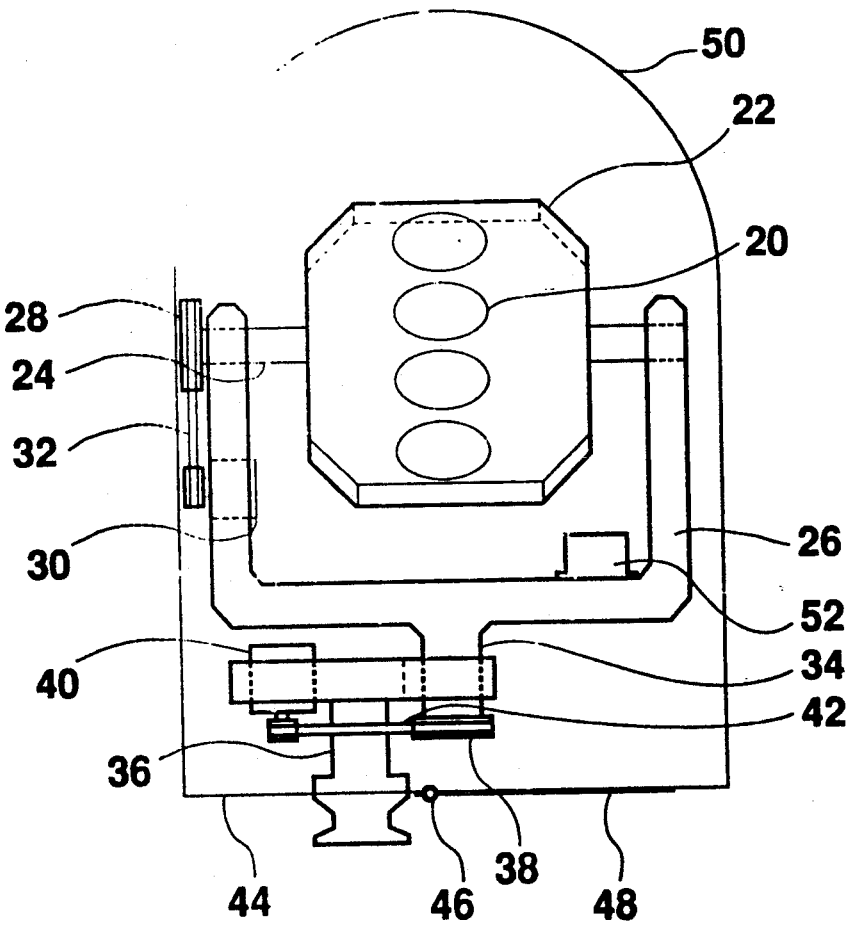
FIG. 1 is a schematic cross section of a first embodiment of a stabilized antenna system according to the present invention.

The present invention will now be described in connection with its preferred embodiments with reference to the attached drawings, wherein like reference characters designate like or corresponding parts throughout the views and thus the repeated description thereof can be omitted for brevity.

Figure 31:
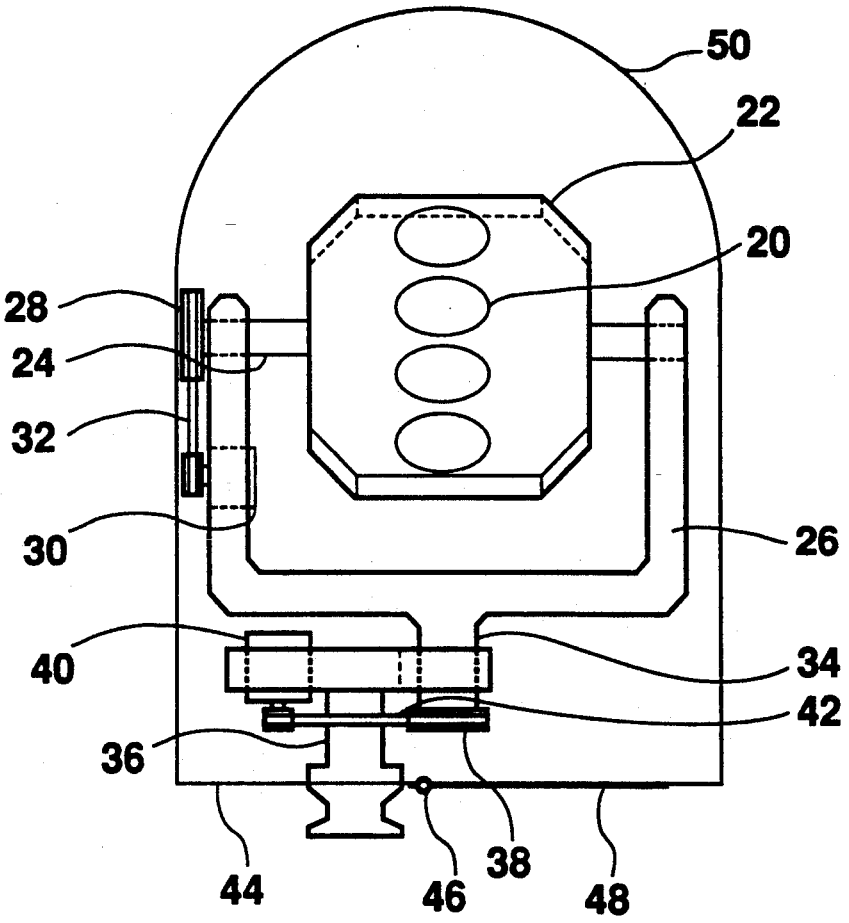
Fig. 31 PRIOR ART
FIG. 31 is another conventional stabilized antenna system.

In FIG. 1, there is shown the first embodiment of a stabilized antenna system according to the present invention, in which members 20 to 50 are the same as those in the conventional stabilized antenna system shown in FIG. 31. In this embodiment, a uniaxial inclination sensor 52 is mounted on an AZ frame 26. Hence, by the rotation of an AZ axis 34, the uniaxial inclination sensor 52 is rotated together with the AZ frame 26. Furthermore, the uniaxial inclination sensor 52 is arranged on the AZ frame 26 so as to detect an inclination component around an EL axis 24, and on the basis of the output of the uniaxial inclination sensor 52, control of an EL axis motor 30 can be carried out.

Figure 2:
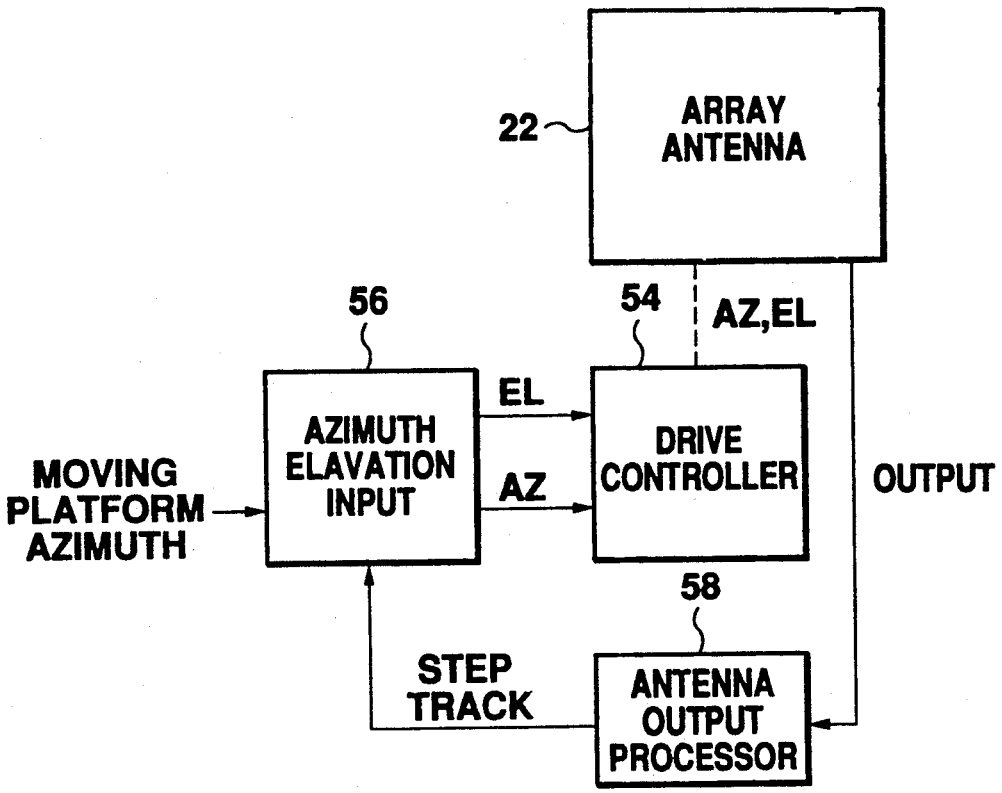
FIG. 2 is a block diagram of an entire circuit structure of the stabilized antenna system shown in FIG. 1.
Figure 32:
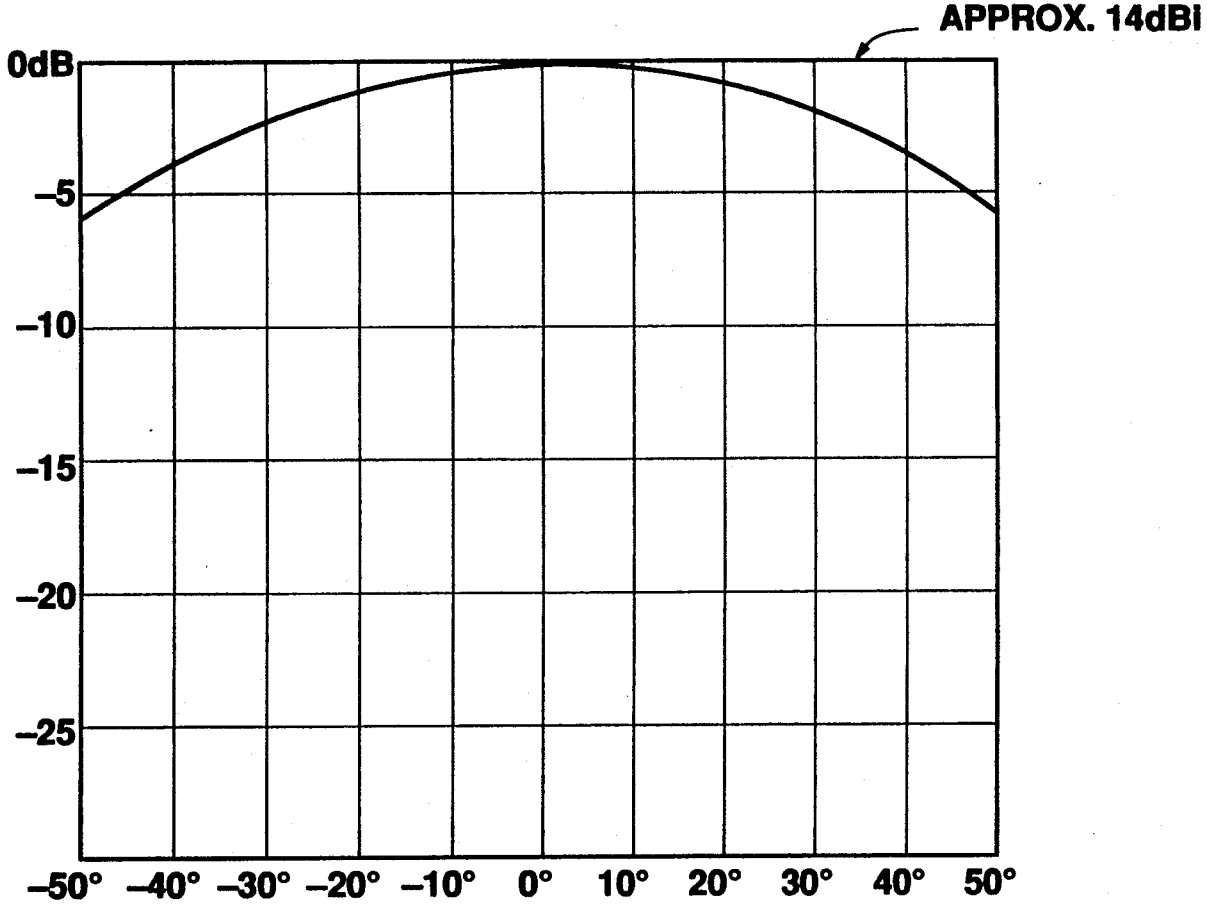
Fig. 32 PRIOR ART
FIGS. 32 and 33 are graphical representations of antenna patterns around a virtual XEL and EL axes, respectively, of a conventional antenna having a fan beam directivity.

In FIG. 2, the entire circuit structure of the stabilized antenna system is shown in FIG. 1, which comprises an array antenna 22, a controller 54, an azimuth and elevation input portion 56 and an antenna output processor 58. The array antenna 22 includes four antenna elements 20 aligned along a longitudinal side of the antenna, as shown in FIG. 1, and realizes antenna patterns shown in FIGS. 32 and 33. The controller 54 drives the array antenna 22 on the basis of satellite elevation (EL) and satellite azimuth (AZ) output from the azimuth and elevation input portion 56 to allow the array antenna 22 to track a satellite (S). The controller 54 also includes a stabilization function for the inclination. The azimuth and elevation input portion 56 inputs a moving platform azimuth (azimuth of a moving platform such as a ship or the like, where the antenna system is mounted) from a gyrocompass or the like, and outputs the elevation (EL) and the relative azimuth (AZ) of the satellite to the controller 54. The antenna output processor 58 inputs the output of the array antenna 22 and conducts a predetermined processing to output a step track angle.

Figure 3:
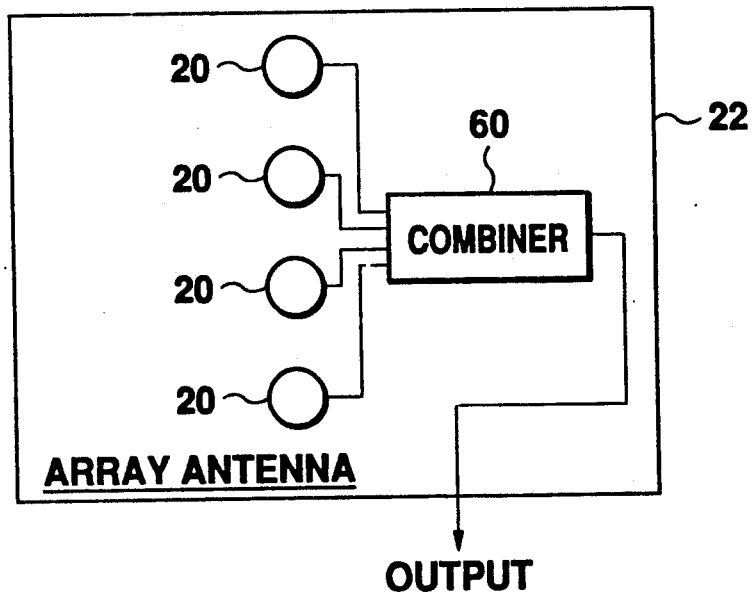
FIG. 3 is a block diagram of an array antenna shown in FIG. 2.

In FIG. 3, there is shown the circuit structure of the array antenna 22 shown in FIG. 2, including four antenna elements 4 longitudinally aligned.

An array antenna, for example, includes an antenna substrate supporting antenna elements, and a feeding substrate laminated with the antenna substrate via the dielectric layer. The array antenna 22 also includes a combiner 60 connected to the four antenna elements 22.

Figure 33:
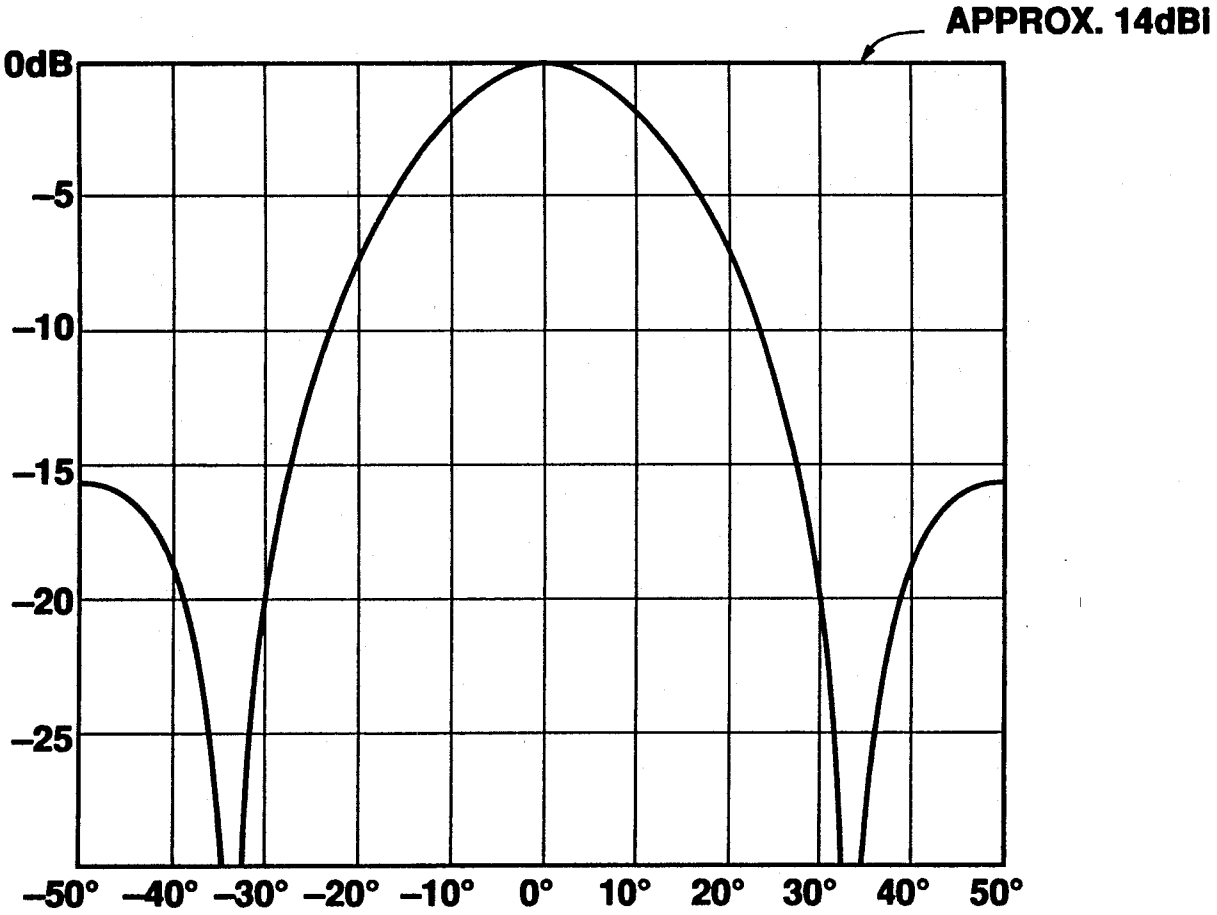
Fig. 33 PRIOR ART

That is, in this embodiment, the outputs of the antenna elements 20 are combined in the combiner 60 to output a combined signal to the antenna output processor 58. Hence, in this case, a single antenna pattern, as shown in FIG. 33 around the EL axis 24, is obtained.

Figure 4:
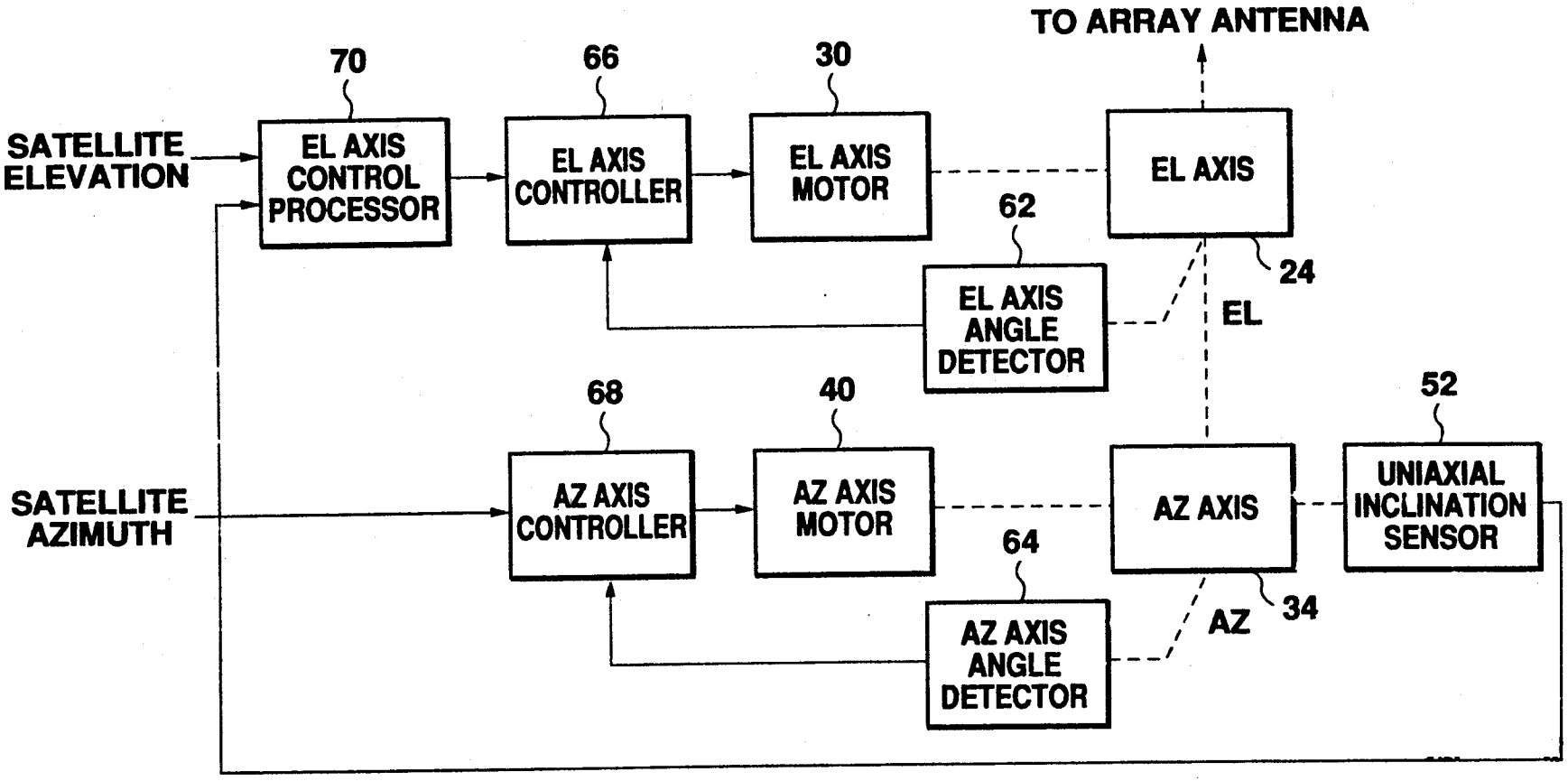
FIG. 4 is a block diagram of a controller shown in FIG. 2.

In FIG. 4, there is shown the structure of the controller 54. The controller 54 includes the EL axis 24, the EL axis motor 30, the AZ axis 34 and the AZ axis motor 40 shown in FIG. 31. That is, the controller 54 is a circuit having a function for mechanically driving the array antenna 22.

The controller 54 further includes an EL axis angle detector 62 for detecting the angle of the EL axis 24. The controller 54 similarly includes an AZ axis angle detector 64 for detecting the angle of the AZ axis 34.

The detection results of the EL axis angle detectors 62 and 64 are fed back to an EL axis control circuit 66 and an AZ axis control circuit 68, respectively. An EL axis control processor 70 takes in the elevation of the satellite to be tracked, that is, the satellite elevation from the azimuth and elevation input portion 56, and calculates an EL axis control amount for controlling the EL Axis motor 30. The calculated result of the EL axis control processor 70 is given to the EL axis control circuit 66, and the EL axis control circuit 66 controls the EL axis motor 30 according to the calculated result of the EL axis control processor 70. The EL axis angle detector 62 feeds back the detected result to the EL axis control circuit 66. Thus, a servo loop for the EL axis is formed.

On the other hand, the AZ axis control circuit 68 takes into account the relative azimuth of the satellite from the azimuth and elevation input portion 56, and controls the AZ axis motor 40 on the basis of the input azimuth. The AZ axis angle detector 64 feeds back the detected result to the AZ axis control circuit 68. Thus, another servo loop for the AZ axis 34 is also formed. The controller 54 can directly take in the relative azimuth of the satellite to the AZ axis control circuit 68 without requiring a member corresponding to the EL axis control processor 70 because the array antenna 22 has the pattern shown in FIG. 32.

Furthermore, the controller 54 is provided with a uniaxial inclination sensor 52. The uniaxial inclination sensor 52 is mounted on the AZ frame 26, as described above, and detects the inclination angle around the EL axis 24. The output of the uniaxial inclination sensor 52 is given to the EL axis control processor 70, and the EL axis control processor 70 calculates the EL axis control amount by using the output of the uniaxial inclination sensor 52 together with the satellite elevation. The calculation formula for the EL axis control amount described above as is follows:

$$\theta = 90^\circ - e1 + q1$$

wherein $\theta$ is the EL axis control amount, e1 is the satellite elevation and q1 is the inclination component around the EL axis 24 of the detected result of the uniaxial inclination sensor 52.

Figure 5:
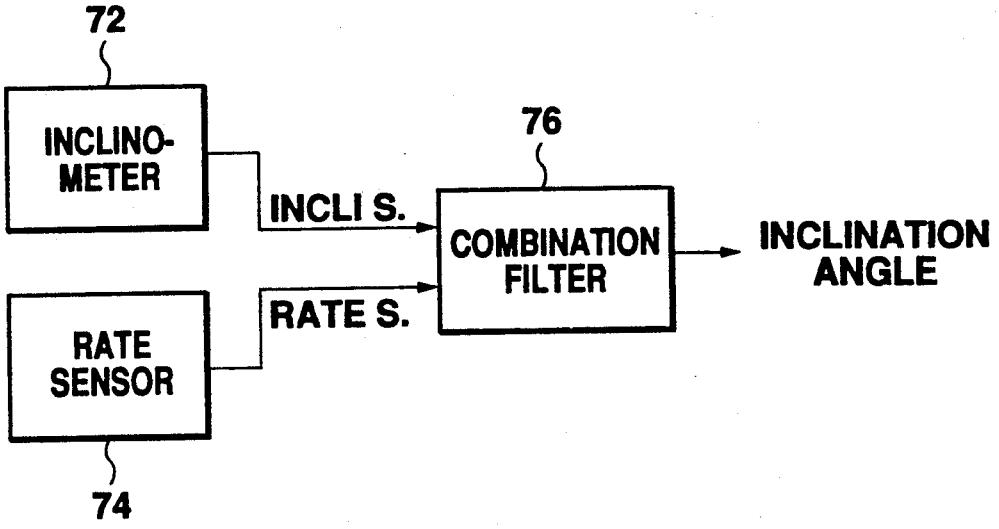
FIG. 5 is a block diagram of a uniaxial inclination sensor shown in FIG. 4.
Figure 6:
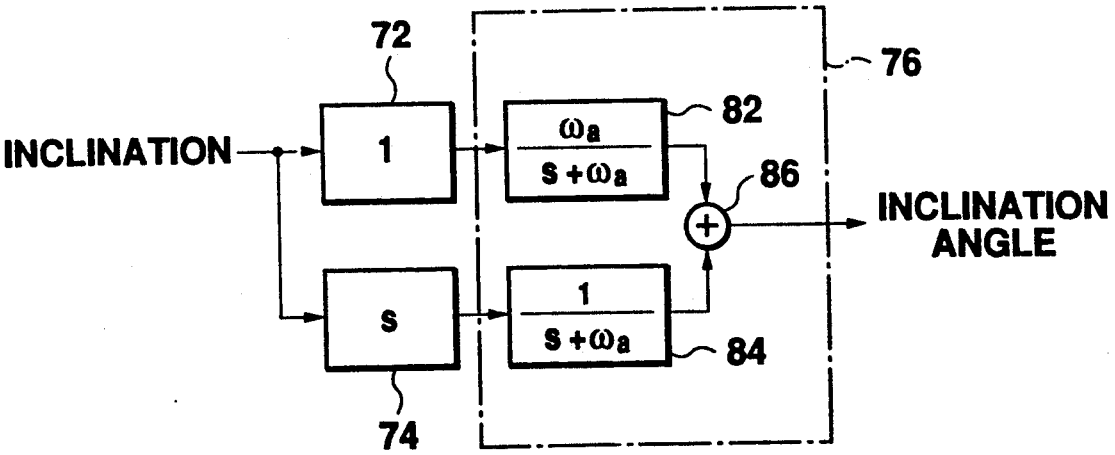
FIG. 6 is a block diagram showing a transfer function model of the uniaxial inclination sensor shown in FIG. 5.

In FIG. 5, there is shown the structure of the uniaxial inclination sensor 52, and FIG. 6 illustrates a transfer function model thereof. In this embodiment, the uniaxial inclination sensor 52 includes an inclinometer 72, a rate sensor 74 and a combination filter 76. The inclinometer 72 is a sensor for detecting the inclination of the moving platform and outputting an inclination signal to the combination filter 76. For example, a pendulum inclinometer can be used.

Figure 7:
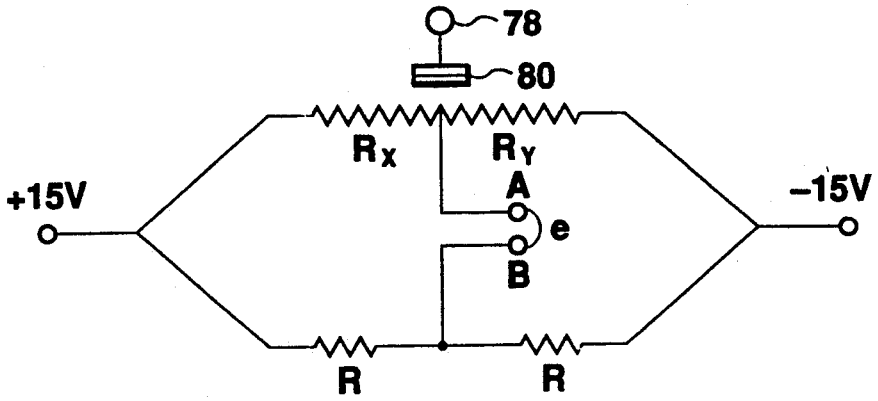
FIG. 7 is a circuit diagram of an inclinometer shown in FIG. 5.

In FIG. 7, there is shown one embodiment of a pendulum inclinometer. In this instance, two resistors R and two magnetoresistance elements $R_X$ and $R_Y$ are connected in bridge form, and a magnet 80, supported as a pendulum, is arranged near the magnetoresistance elements $R_X$ and $R_Y$. When the ship is inclined in this state, the magnet 80 is inclined accordingly, and the bridge is unbalanced to generate an output electric potential e between terminals A and B. This output electric potential e represents the inclination angle of the ship.

In turn, the rate sensor 74 is a sensor for detecting an angular velocity of the moving platform. For the rate sensor 74, for example, a solid state type can be used, and a rate signal output from the rate sensor 74 is fed to the combination filter 76.

Now, assuming that the input to the inclinometer 72 and the rate sensor 74 is the inclination angle of the moving platform in a predetermined direction, the transfer function of the inclinometer 72 is 1, and the transfer function of the rate sensor 74 is s. The combination filter 76 includes a filter A 82 denoted as a transfer function of $\omega_a/(s+\omega_a)$ ($\omega_a$: cutoff angular frequency), a filter B 84 denoted as a transfer function of $1/(s+\omega_a)$, and an adder 86 for adding the outputs of the two filters A 82 and B 84.

Hence, the total transfer function of the inclinometer 72 and the filter A 82 is $\omega_a/(s+\omega_a)$, and the total transfer function of the rate sensor 74 and the filter B 84 is $s/(s+\omega_a)$ . Thus, the transfer function seen from the output of the adder 86 is $\omega_a(s+\omega_a)+s/(s+\omega_a)=1$. In other words, the transfer function with respect to the inclinometer 72 and the filter A 82 and the transfer function with respect to the rate sensor 74 and the filter B 84 are mutually reciprocal.

Figure 8:
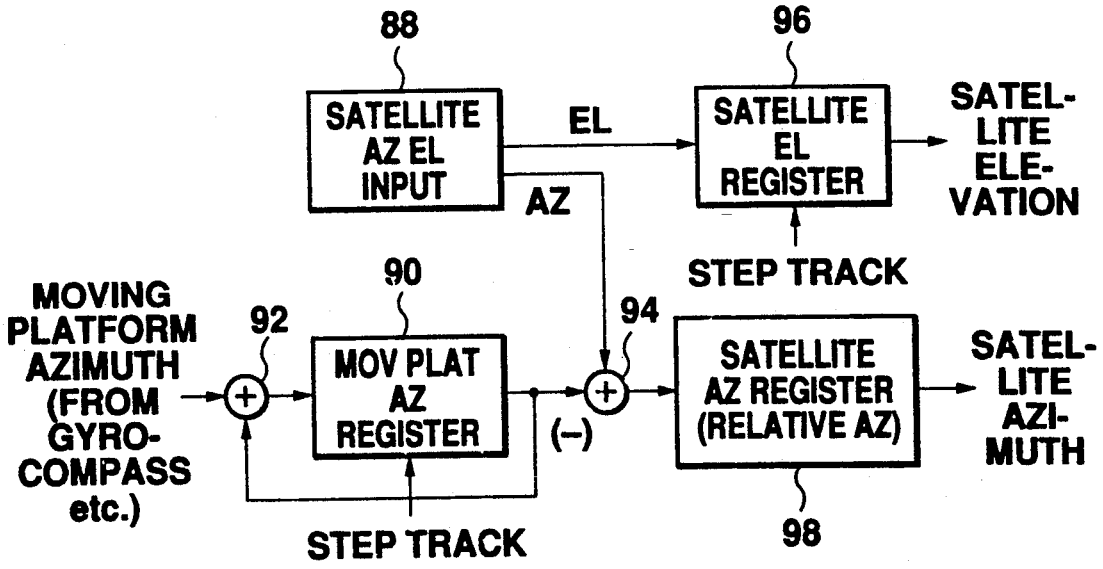
FIG. 8 is a block diagram of an azimuth and elevation input portion shown in FIG. 2.

In FIG. 8, there is shown the construction of the azimuth and elevation input portion 56 including an satellite azimuth and elevation input means 88, a moving platform azimuth register 90, adders 92 and 94, a satellite elevation register 96 and a satellite relative azimuth register 98. The satellite azimuth and elevation input means 88, for example, takes in information concerning the azimuth and elevation of the satellite from a navigation system such as a GPS (global positioning system) or the like. The satellite azimuth taken in by the satellite azimuth and elevation input means 88 is an absolute azimuth, that is, an azimuth based on a longitude line of the globe. In turn, since the azimuth to be fed to the controller 54 is the relative azimuth of the satellite, the absolute azimuth is added to the moving platform azimuth in the azimuth and elevation input portion 56.

For carrying out this operation, the azimuth and elevation input portion 56 takes in a moving platform azimuth variation from a device such as a gyrocompass or the like. In order to execute the moving platform azimuth, the moving platform azimuth register 90 for storing the present moving platform azimuth, and the adder 92 arranged before the moving platform azimuth register 90 for adding the output of the moving platform azimuth register 90 with the moving platform azimuth variation are provided.

In the adder 94 arranged after the moving platform azimuth register 90, the moving platform azimuth stored in the register 90 is subtracted from the absolute azimuth (AZ) fed from the satellite azimuth and elevation input means 88. The satellite elevation register 96 once stores the satellite elevation (EL) output from the satellite azimuth and elevation input means 88. The satellite relative azimuth register 98 once stores the relative azimuth of the satellite, obtained by the adder 94.

The elevation stored in the register 96 and the relative azimuth stored in the register 98 are supplied to the controller 54, and thus the tracking of the satellite by the array antenna 22 is carried out.

In this instance, as to the satellite elevation register 96 and the moving platform azimuth register 90, a so-called step track control is conducted. The step track control is performed by a step track angle output from the antenna output processor 58.

Figure 9:
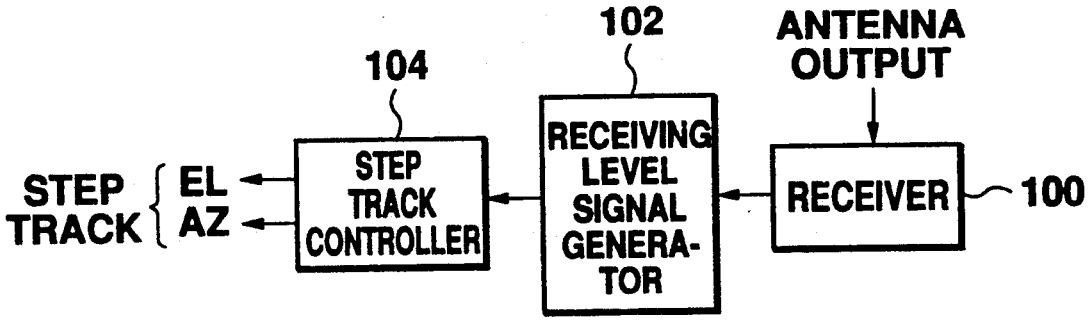
FIG. 9 is a block diagram of an antenna output processor shown in FIG. 2.

In FIG. 9, there is shown the structure of the antenna output processor 58 for carrying out the step track control. The circuit shown in FIG. 9 shows a part of receiver equipment for the satellite communication or for the satellite broadcasting, and particularly only shows the construction relating to a detection of an azimuth error.

The antenna output processor 58 includes a receiver 100, a receiving level signal generator 102 and a step track control circuit 104. The receiver 100 takes in the output of the array antenna 22.

The receiving level signal generator 102 generates a receiving level signal depending on the output of the receiver 100. The receiver 100 converts the antenna output into a lower frequency, and outputs an IF signal to the receiving level signal generator 102. The receiving level signal generator 102 takes in the IF signal output from the receiver 100, and estimates the carrier to noise density ratio C/NO from the carrier level or the like contained in the IF signal. The receiving level signal generator 102 produces a receiving level signal of a monotone increase value against the estimated C/NO. The produced receiving level signal is input to the step track control circuit 104.

The step track control circuit 104 produces the step track angles for the elevation and azimuth on the basis of the receiving level signal output from the receiving level signal generator 102. That is, the step track angle output from the step track control circuit 104 is supplied to the satellite elevation register 96 and the moving platform azimuth register 90. When the step track angle is given to these registers 96 and 90, their contents are slightly adjusted or corrected.

In this instance, the specific structure of the step track control circuit 104 is basically disclosed in Japanese Patent Application No.Hei 2-175014 and No.Hei 2-240413 applied by the present applicant, and thus the detail of the step track control circuit 104 can be omitted.

Next, the particular operation of the stabilized antenna system, described above and according to the present invention, will now be described.

In this embodiment, when the inclination is caused on the ship during satellite tracking control, the inclination component around the EL axis 24 is detected by the uniaxial inclination sensor 52. This detection result is obtained by the combination filter 76 for realizing the reciprocal transfer functions, and the accuracy can be assured in the necessary frequency band. The output of the uniaxial inclination sensor 52 is given to the EL axis control processor 70, and the EL axis control processor 70 executes the subtraction for the satellite elevation to calculate the EL axis control amount. In other words, only the subtraction for the output of the uniaxial inclination sensor 52 is carried out, and the EL axis 24 is rotated so as to compensate or stabilize the inclination component.

Figure 29:
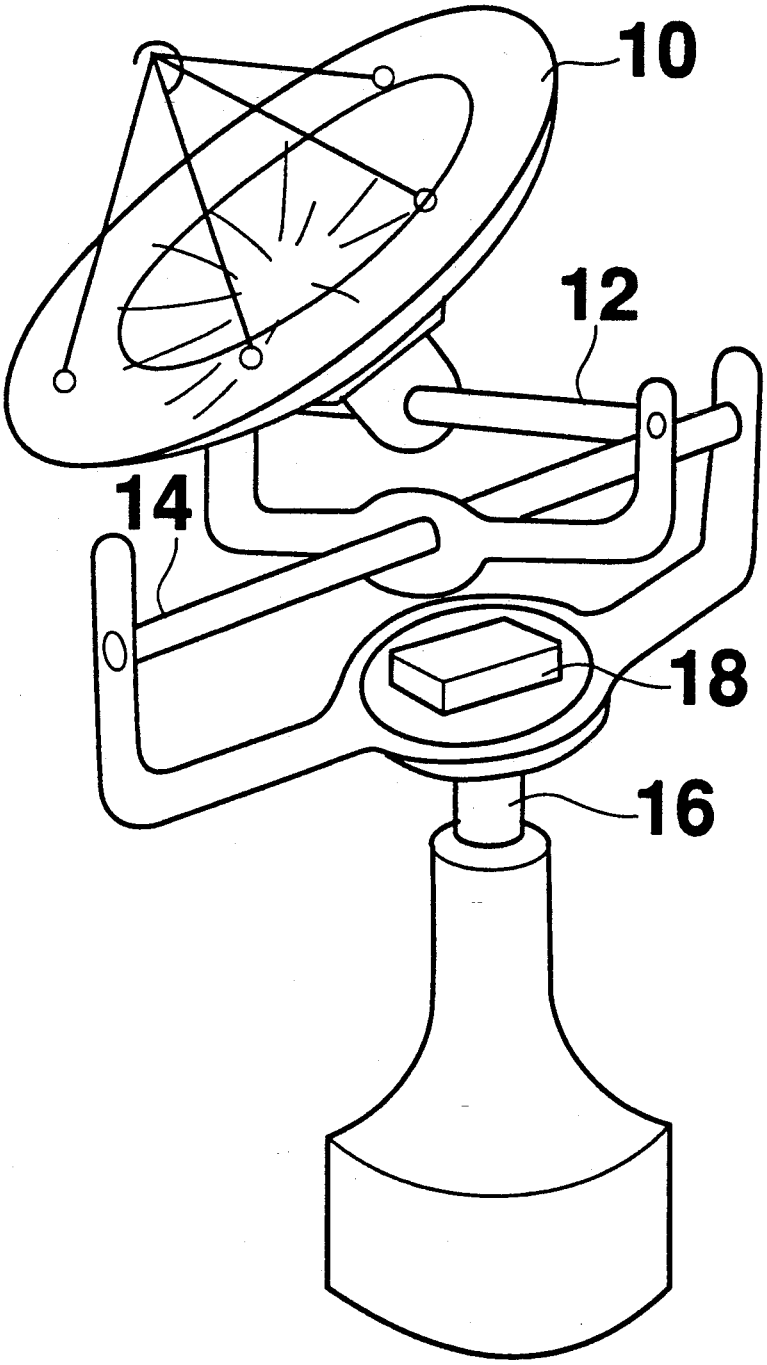
Fig. 29 PRIOR ART
FIG. 29 is a conventional stabilized antenna system.
Figure 30:
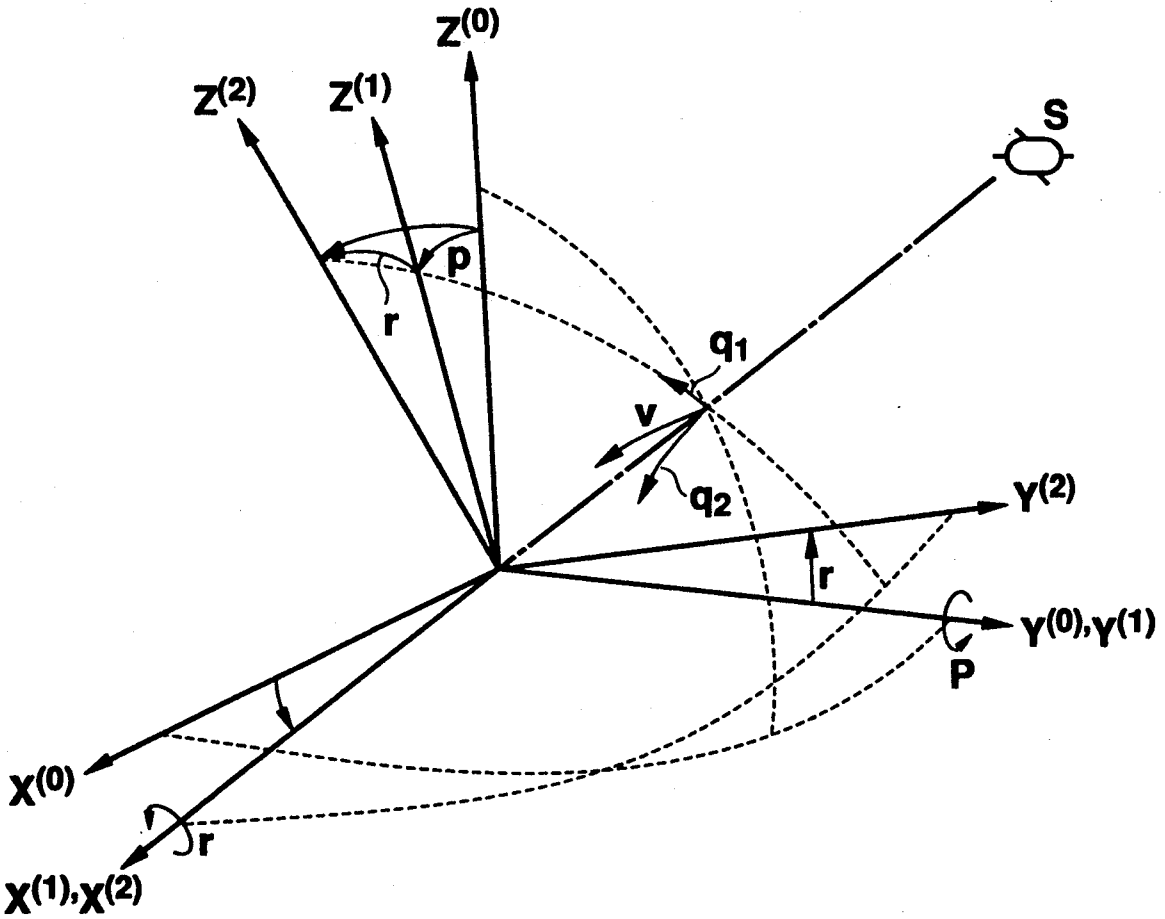
Fig. 30 PRIOR ART
FIG. 30 is a schematic view showing a principle of a conventional stabilization of an inclination.

Therefore, in this embodiment, the stabilization of the moving platform such as a ship or the like, can be practiced by an extremely simple arithmetic algorithm, as compared with conventional stabilized antenna systems. This is the reason why fan beam directivity is realized by the array antenna 22, and the uniaxial inclination sensor 52 is mounted on the AZ frame 26 so as to detect the inclination angle around the EL axis 24. Furthermore, since the inclination detector means as the uniaxial inclination sensor 52 is constructed so as to detect only the inclination angle around the EL axis 24, there is no need to carry out the detection of the drive components in two directions like the conventional attitude sensor 18 shown in FIG. 29. The above-described effects can be realized by the inexpensive inclination detector means implemented at approximately half the cost of the conventional one. Furthermore, by properly determining the number, such as 4 to 5, of the antenna elements 20, the influence of the sea surface reflection can also be reduced.

Figure 10:
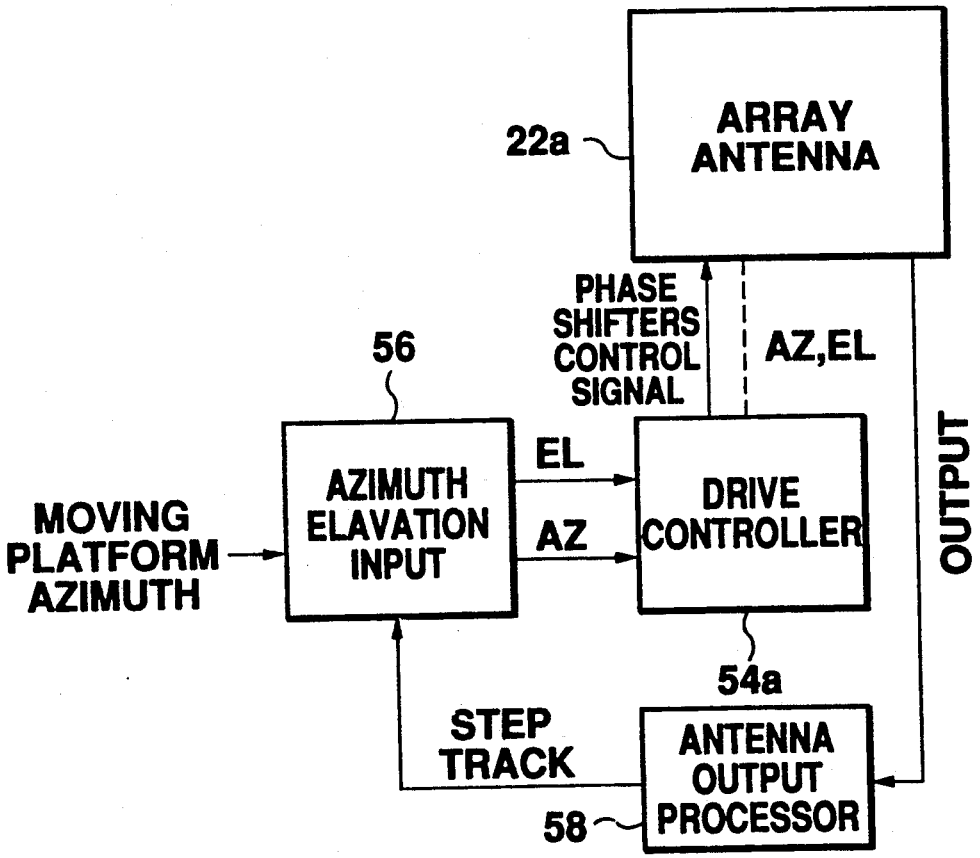
FIG. 10 is a block diagram of a second embodiment of a stabilized antenna system according to the present invention.

In FIG. 10, there is shown the whole circuit structure of the second embodiment of a stabilized antenna system according to the present invention. It has the same construction as the first embodiment, which is shown in FIG. 2, except for an array antenna **22*a* and a controller 54*a* which outputs a phase shifter control signal (p.s. control) for controlling a phase shift amount in the array antenna 22*a***.

Figure 11:
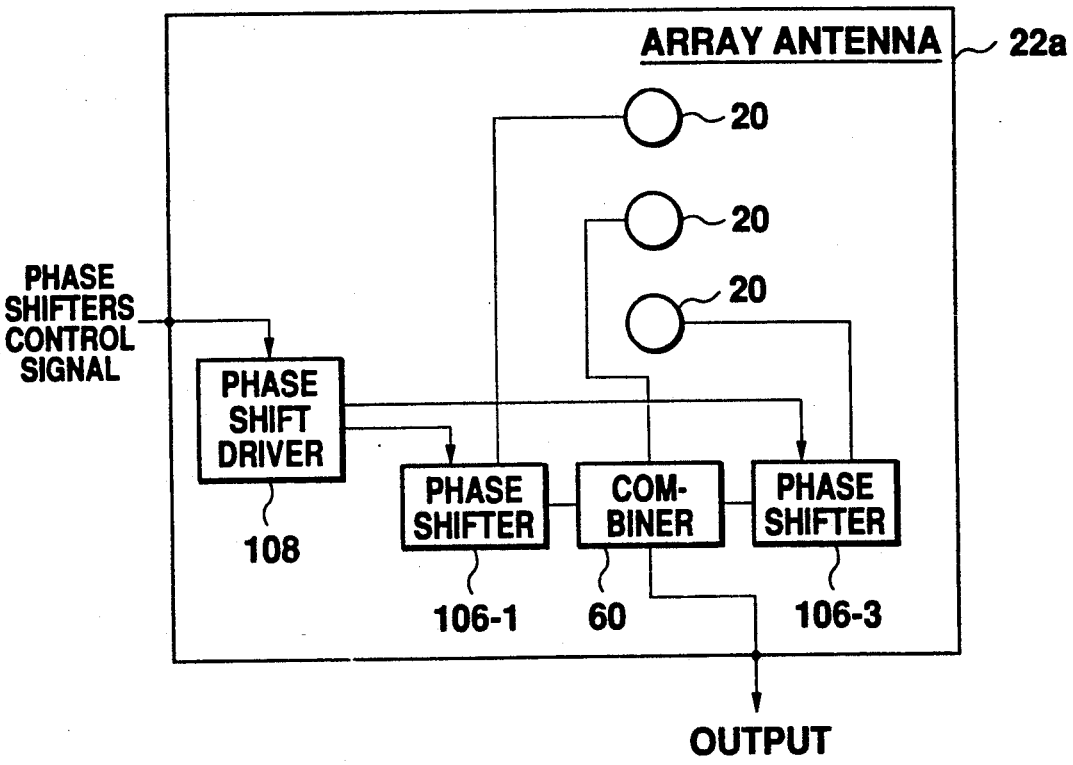
FIG. 11 is a block diagram of an array antenna shown in FIG. 10.

In FIG. 11, there is shown the structure of the array antenna **22*a* shown in FIG. 10. The array antenna 22*a* includes three antenna elements 20 longitudinally aligned, a combiner 60 coupled to the middle antenna element 20, two phase shifters 106-1 and 106-3 connected to the upper and lower antenna elements 20, respectively, and a phase shifter drive circuit 108 for driving the two phases shifters 106-1 and 106-3**.

In this embodiment, by controlling the phase shift amounts by the phase shifters 106-1 and 106-3, the beam positions of the array antenna **22*a* can be switched around the EL axis 24. In order to enable the beam position switching, the phase shifter drive circuit 108 for driving the phase shifters 106-1 and 106-3** is provided.

Figure 12:
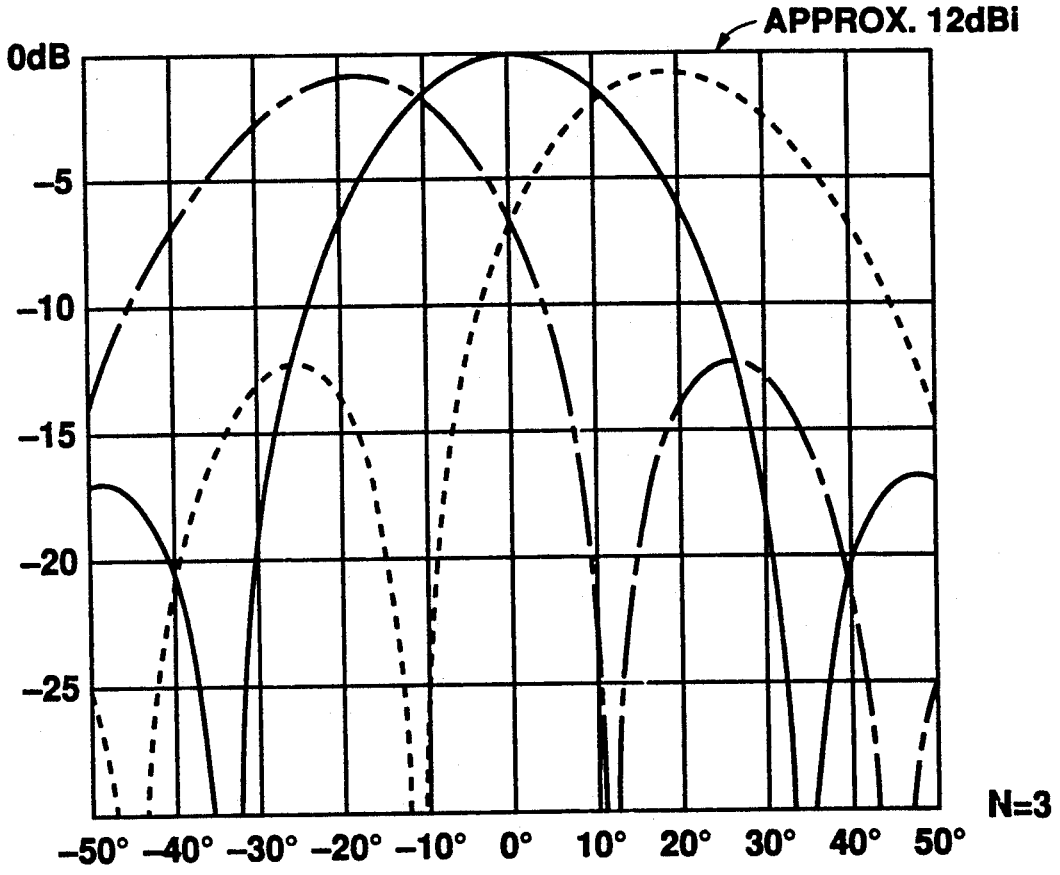
FIG. 12 is a graphical representation of a beam position around a supplementally EL axis of the array antenna shown in FIG. 11 when N=3.

The phase shifter drive circuit 108 executes the control of the phase shifters 106-1 and 106-3 according to the phase shifter control signal supplied from the controller **54*a*. More specifically, the digital signal is supplied to the phase shifters 106-1 and 106-3 depending on the bit numbers of the phase shifters 106-1 and 106-3. The outputs of the phase shifters 106-1 and 106-3 along with the output of the middle antenna element 20 are fed to the combiner 60 and are combined therein, and the combined signal is output from the combiner 60 to the antenna output processor 58. At this time, when the phase shifters 106-1 and 106-3 are controlled by the phase shifter driver circuit 108, for example, the beam positions around the EL axis 24 of the array antenna 22*a* are switched, as shown in FIG. 12. In this embodiment, the bit number for the phase shifters 106-1 and 106-3 is 2 bits, and thus the beam position can be controlled to be switched into three types. Since the beam position switching is carried out around the EL axis 24, this can be called a supplementary EL axis. That is, the actual EL axis 24 is the mechanical axis driven and rotated by the EL axis motor 30, and the beam position switching by the control of the phase shifters 106-1 and 106-3 can assist the EL axis 24**. In this embodiment, the inclination can be solely compensated or stabilized by this supplementary EL axis.

Figure 13:
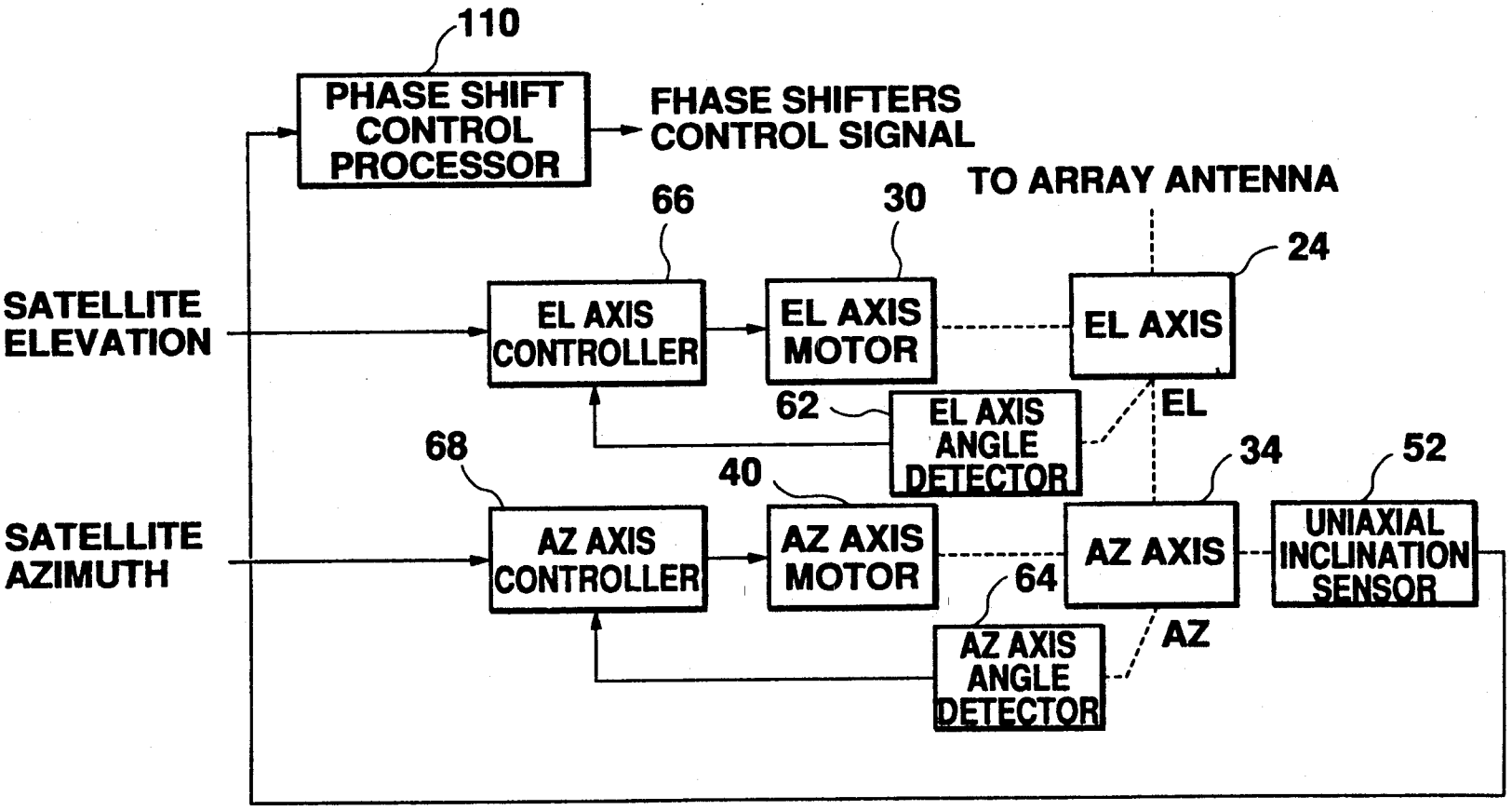
FIG. 13 is a block diagram of a controller shown in FIG. 10.

In FIG. 13, there is shown the construction of the controller **54*a* shown in FIG. 10 for supplying the phase shifter control signal (p.s. control) to the phase shifter drive circuit 108 of the array antenna 22*a***.

In this embodiment, the controller **54*a* has the same construction as the controller 54 of the first embodiment shown in FIG. 4, except that an output of a uniaxial inclination sensor 52 is fed to a phase shifter control amount processor 110, and the satellite elevation output from the azimuth and elevation input part 56 is directly input to an EL axis control circuit 66. The phase shifter control amount processor 110 produces the phase shifter control signal for compensating or stabilizing the inclination component around the EL axis 24 and outputs the phase shifter control signal to the phase shifter drive circuit 108. That is, in this embodiment, the AZ axis 34 and the EL axis 24 are driven only to allow the array antenna 22*a* to track the satellite, and the stabilization of the inclination is carried out solely by the phase shifter control signal output from the phase shifter control amount processor 110**.

Accordingly, in this embodiment, the same effects and advantages as those described in the first embodiment can be obtained. In addition, the stabilization of the inclination of the moving platform can be performed only by the phase shifter control signal, and thus the servo loop with respect to the AZ axis 34 can be of a relatively low speed. This is the reason why the variation of the satellite elevation and the variation of the relative azimuth of the satellite are caused by the variation of the azimuth, the movement and the like of the moving platform (such as the ship) and are of a lower speed than the inclination. Hence, the controller **54*a*** can be produced at low cost, and the response to the inclination can be maintained at a relatively high speed.

Figure 14:
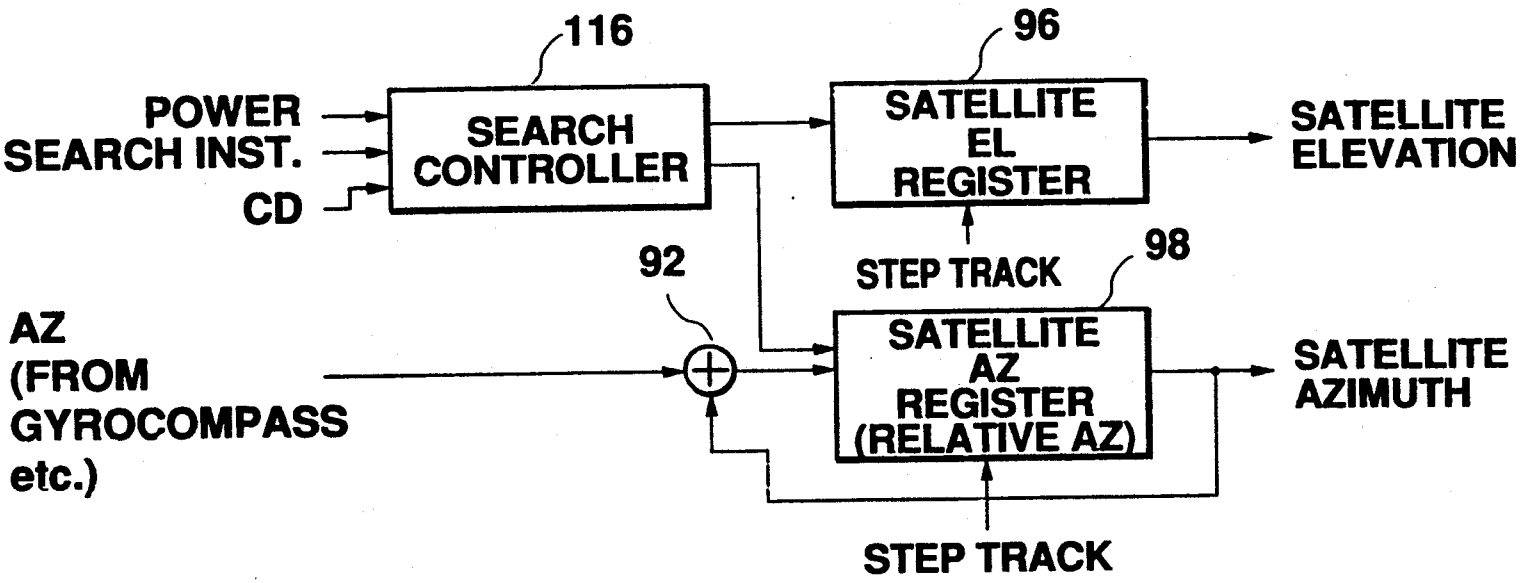
FIG. 14 is a block diagram of an azimuth and elevation input portion of a third embodiment of a stabilized antenna system according to the present invention.

In FIG. 14, there is shown a structure of an azimuth and elevation input portion 56 of the third embodiment of a stabilized antenna system according to the present invention. In this embodiment, the azimuth and elevation input portion includes an adder 92, a satellite elevation register 96, a satellite relative azimuth register 98 and a search controller 116 in place of the satellite azimuth and elevation input means 88 of the first embodiment shown in FIG. 8. The feature of this embodiment is to use controlling with respect to the relative azimuth in the azimuth and elevation input portion.

That is, as shown in FIG. 14, the search controller 116 carries out a search operation in response to a power on, a search instruction or the like. In this instance, the structure of the search controller 116 is formed by adapting a structure of an azimuth search control circuit disclosed in Japanese Patent Application No.Hei 2-240413 applied by the present applicant. In this embodiment, the output such as the satellite elevation and the relative azimuth of the satellite of the search controller 116 is fed to the satellite elevation register 96 and the satellite relative azimuth register 98, and the search control of both the satellite elevation and the relative azimuth of the satellite is performed. The step track control is practiced to both the satellite elevation register 96 and the satellite relative azimuth register 98.

Figure 15:
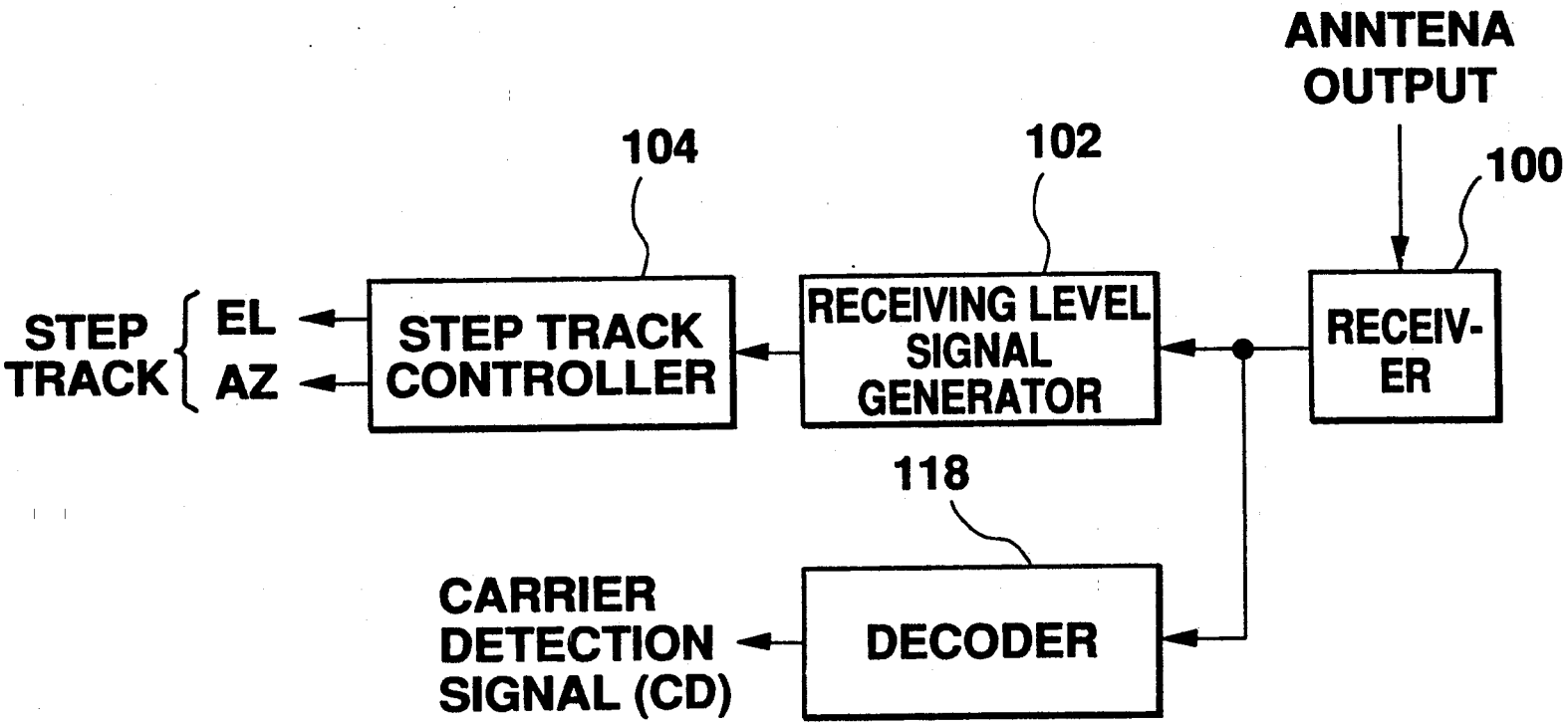
FIG. 15 is a block diagram of an antenna output processor of the third embodiment of the stabilized antenna system according to the present invention.

In FIG. 15, there is shown a construction of an antenna output processor for producing a carrier detection signal (CD) to be input to the azimuth and elevation input portion shown in FIG. 14 in the third embodiment. In this embodiment, the antenna output processor has the same structure as the first embodiment as shown in FIG. 9, except that a decoder 118 is further provided. The decoder 118 takes in the IF signal from the receiver 100, detects a carrier from the IF signal and outputs the carrier detection signal (CD) for representing whether or not a desired signal is received by at least a fixed level. The carrier detection signal is fed to the search controller 116 of the azimuth and elevation input portion, and the search controller 116 carries out the search control accordingly.

Hence, in this embodiment, the same effects and advantages as those of the first and second embodiments can be obtained.

As described in the above embodiments, although 3 to 4 antenna elements 20 are arranged around the EL axis 24 in the array antenna, however, the present invention is not restricted to these arrangements. For example, a plurality of antenna elements can be aligned along two lines. In this instance, the beam width around the virtual XEL axis becomes narrower compared with one line alignment, and hence the inclination becomes apt to be somewhat of an influence. However, on the contrary, the height of the array antenna is reduced compared with the one line alignment, with the same number of antenna elements 20, and thus the combined gain is substantially equal. Accordingly, such a structure can be effective on a ship where an inclination component to be stabilized is small, for example, a ship in an inland water channel, a deep-draft ship or the like.

Figure 16:
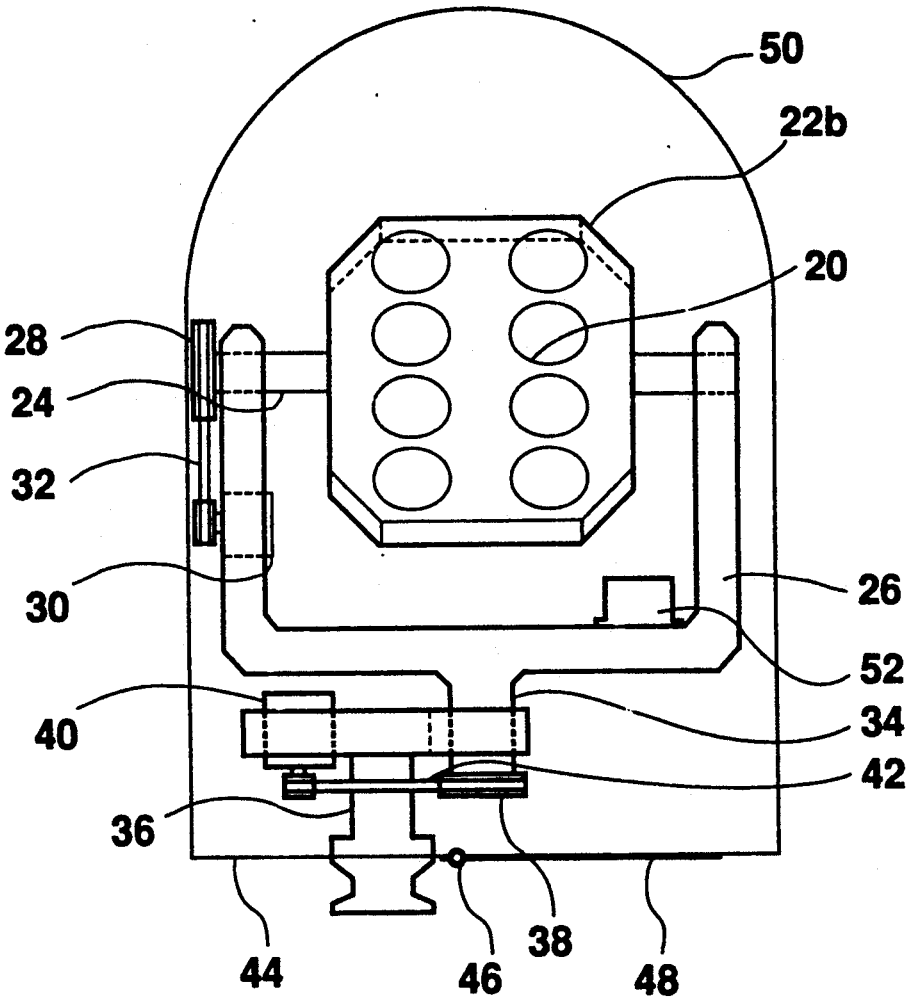
FIG. 16 is a schematic cross section of a fourth embodiment of a stabilized antenna system according to the present invention.

In FIG. 16, there is shown a fourth embodiment of a stabilized antenna system according to the present invention, having the same construction as the first embodiment, shown in FIG. 1, except that an array antenna **22*b* includes antenna elements 20** aligned in a 4×2 matrix form.

Figure 17:
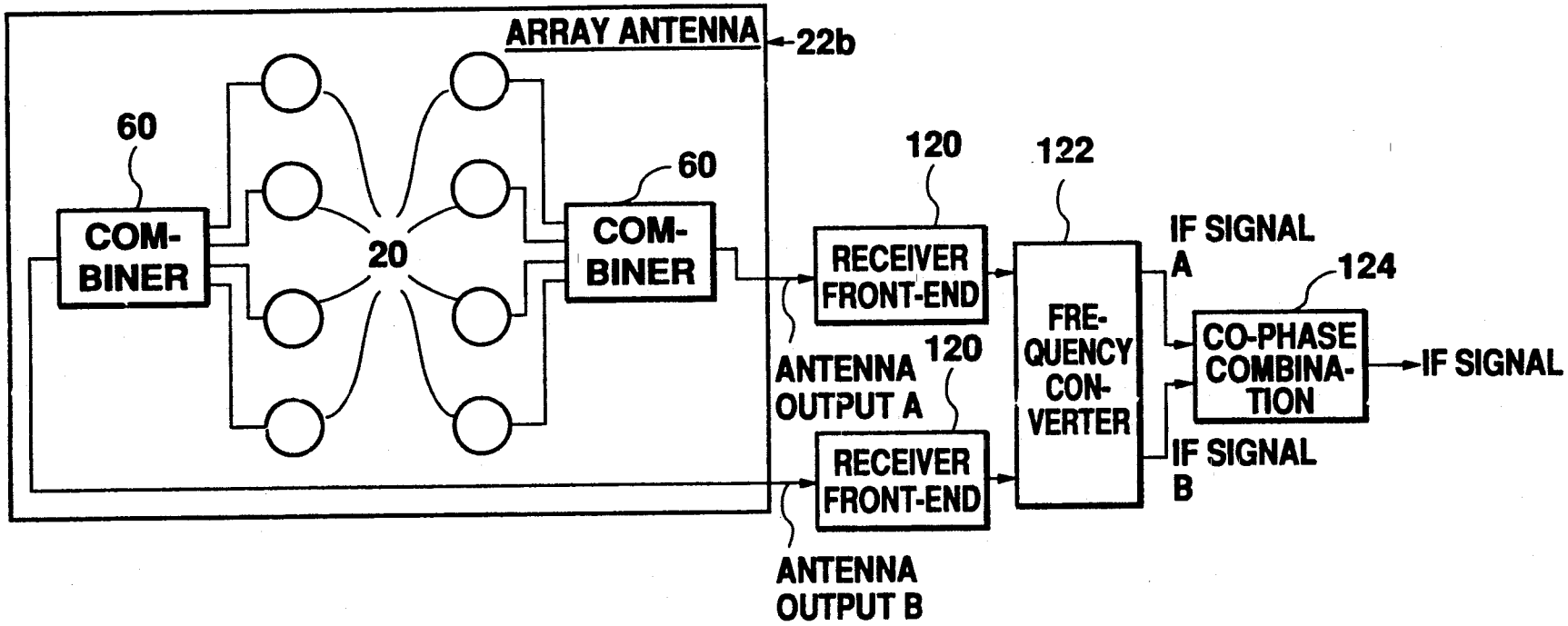
FIG. 17 is a block diagram of a circuit structure of an array antenna shown in FIG. 16.
Figure 18:
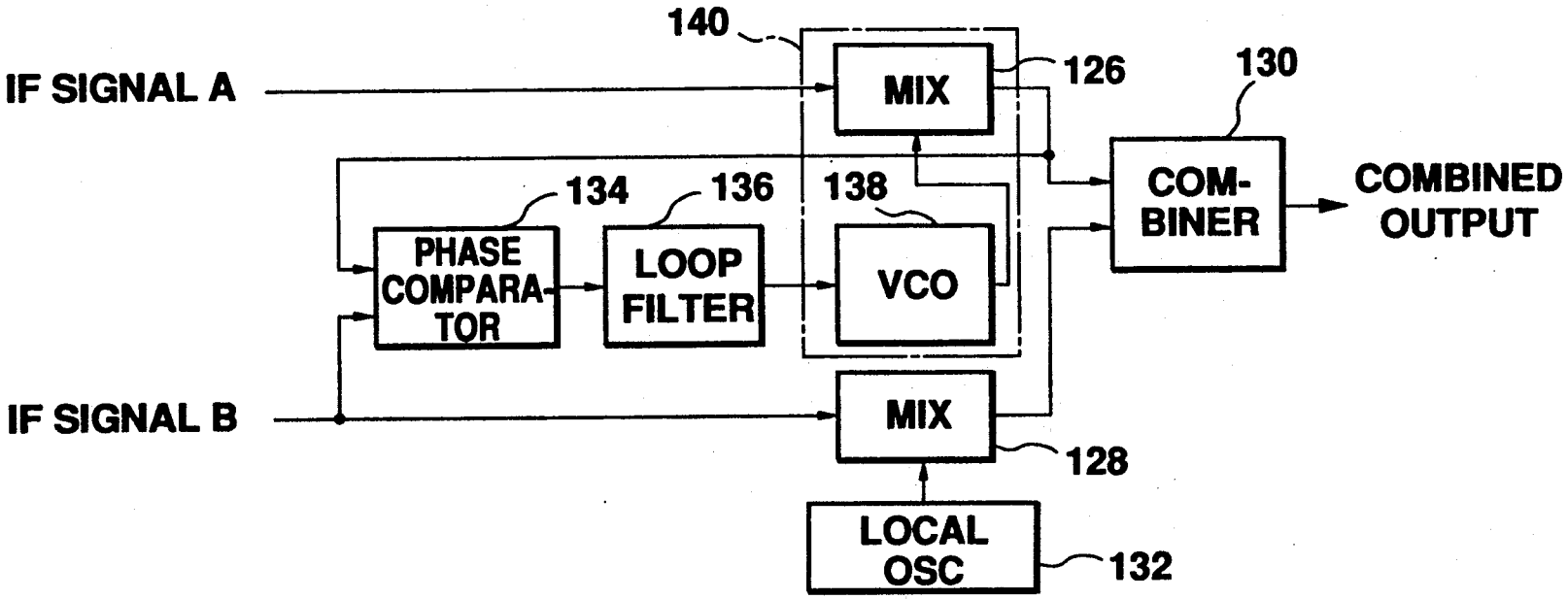
FIG. 18 is a block diagram of a co-phase combination circuit shown in FIG. 17.

FIGS. 17 and 18 show a part of the circuit structure of the fourth embodiment of the stabilized antenna system shown in FIG. 16. That is, FIG. 17 shows a circuit structure of the array antenna **22*b*, and FIG. 18 shows a circuit structure of a co-phase combination circuit shown in FIG. 17**.

In FIG. 17, since the antenna elements 20 are arranged in 4 lows×2 columns in the array antenna **22*b*, as shown in FIG. 16, the structure of the output processing of the array antenna 22*b* is different from the array antenna 22 of the first embodiment shown in FIG. 2. That is, although the beam width around the virtual XEL axis is narrowed due to the two line arrangement of the antenna elements, by the structure shown in FIG. 17**, the fan beam directivity equivalent to the one line arrangement of the antenna elements can still be realized.

As shown in FIG. 17, in the array antenna **22*b*, one combiner 60 is provided for each line of four antenna elements 20. The outputs (antenna outputs A and B) of the two combiners 60 are sent to a pair of receiver front-ends 120 for processing, such as, amplification and the like. The receiver front-ends 120, each of which include the LNA and the like, are arranged near the array antenna 22*b*, and separately bear a partial function of the receiver 100. The array antenna 22*b* further includes a frequency converter 122 for converting the output of each receiver front-end 120 into a predetermined IF signal A or B, and a co-phase combination circuit 124 for executing a co-phase combination of the IF signals A and B output from the frequency converter 122 and outputting a combined IF signal to the receiver 100**.

That is, the gain is improved at reception. For example, comparing a case of 6 antenna elements 20 arranged along one line with a case of 8 antenna elements 20 arranged along two lines, the combined gain is increased due to the increased number of antenna elements 20. Furthermore, the number of antenna elements 20 arranged around the EL axis 24 for each line is reduced from six to four, and the system is lowered in height and becomes compact in size. When the number of the antenna elements 20 per line is equal, the receive gain of the two line arrangement is increased by the maximum of 3 dB compared with the one line arrangement.

In order to obtain this effect, the co-phase combination circuit 124 is constructed, as shown in FIG. 18. The co-phase combination circuit 124 includes a pair of mixers 126 and 128 correspond to the respective IF signals A and B, and a combiner 130 for combining the outputs of the mixers 126 and 128 to output a combined IF signal. In the co-phase combination circuit 124, a local oscillator 132 for generating a signal having predetermined frequency and phase is connected to the mixer 128, and a phase comparator 134 compares the output phase of the mixer 126 and the phase of the IF signal B to output a signal exhibiting a phase difference between the two signals to a loop filter 136. Furthermore, In the co-phase combination circuit 124, the loop filter 136 extracts the signal exhibiting the phase difference from the output of the phase comparator 134 and outputs it to a VCO (voltage controlled local oscillator) 138, and the VCO 138 controls the oscillation phase depending on the output signal value (voltage) of the loop filter 136 and oscillates at the same frequency as the local oscillator 132 to output a signal to the mixer 126. The mixer 126 and the VCO 138 constitute a phase shifter 140.

That is, in this embodiment, the IF signals A and B are mixed with the output signals of the VCO 138 and the local oscillator 132 in the mixers 126 and 128, respectively, and the outputs of the mixers 126 and 128 are combined in the combiner 130. The output phase of the VCO 138 is adjusted depending on the comparison result of the phase comparator 134 so that the output phase of the mixer 126 may be equal to the output phase of the mixer 128.

Hence, in this embodiment, at the receiving time, by the co-phase combination, the satellite can be electronically tracked around the virtual XEL axis, and in spite of the narrow beam width around the virtual XEL axis, the fan beam directivity equivalent to that of the one line arrangement of the antenna elements can be obtained. The tracking range can be determined depending on the beam width of the individual antenna element 20, the C/NO, the performance of the co-phase combination circuit 124, and the like. Since the phase comparison operation is required, such effects can be expected only at the receiving time.

According to the present invention, as described above, although the AZ axis 34 and the radome 50 are separately constructed, these two members can be integrally formed with the same effects as those obtained in the embodiments. One example of an antenna system including the AZ axis 34 and the radome 50 integrally constructed is disclosed in applicant's Japanese Patent Application No.Hei 3-040297. In other words, the azimuth axis structure of this antenna system can be applied to the antenna system according to the present invention. In this case, the radome 50 can be small-sized. Furthermore, the uniaxial inclination sensor 52 can be mounted on a supplementary rotation mount rotating in synchronism with the AZ axis 34.

As described above, according to the present invention, the antenna having fan beam directivity is rotatably supported by two mechanical axes, and the inclination sensor means for detecting the inclination component around the EL axis is mounted onto the AZ frame. Therefore, the stabilization of the antenna can be performed by using the simple control algorithm, and the structure of the inclination sensor means can be more simplified. As a result, an inexpensive and small-sized stabilized antenna system can be implemented. Furthermore, the fan beam directivity can be also obtained by the array antenna.

According to the present invention, the reciprocal transfer functions are realized and the detection of the inclination component is carried out by using both the inclinometer and the rate sensor as discussed above. Hence, accurate inclination detection can be performed by a simple structure, and the small-size and cost reduction of the antenna system can be achieved.

Figure 19:
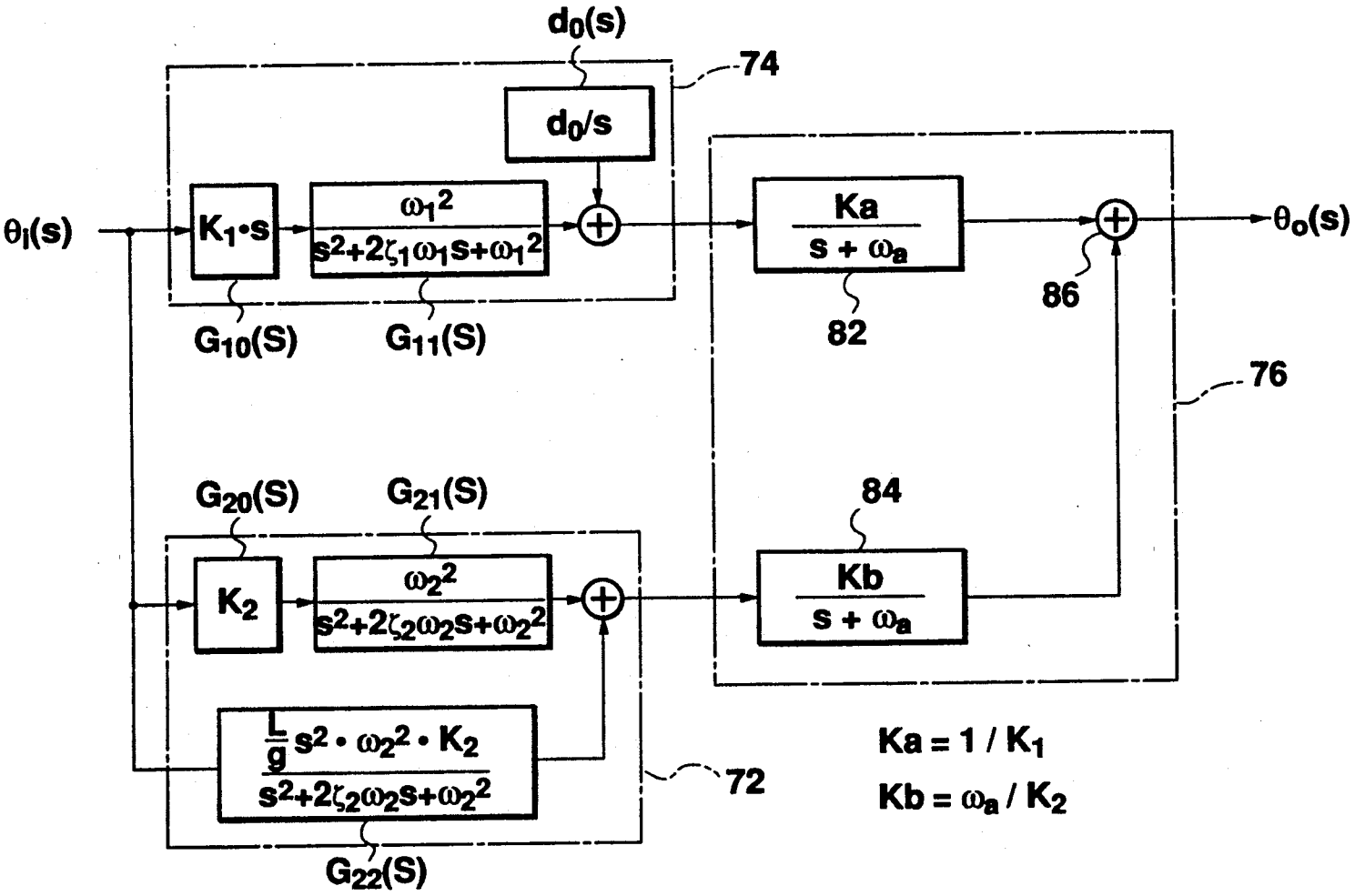
FIG. 19 is a block diagram of a detailed transfer function model of a uniaxial inclination sensor to be applicable to the first to fourth embodiment of a stabilized antenna system according to the present invention.

In FIG. 19, there is shown a detailed transfer function model of the uniaxial inclination sensor 52 to be applicable to the above-described embodiments.

The rate sensor 74 is formed of a piezoelectric type rate sensor or the like, and possesses the following transfer function:

$$G_{10}(s)=K_1\cdot s \ (K_1\text{: constant})$$

That is, the rate sensor 74 is a sensor which outputs the differential of an inclination angle $\theta_1(s)$ to be added. In FIG. 19, $G_{11}(s)$ and $d_0(s)$ represent parasitic elements having an LPF characteristic and an offset and their drift, respectively, and are expressed as follows:

$$G_{11}(s) = \frac{\omega_1^2}{s^2 + 2\zeta_1\omega_1 s + \omega_1^2}$$

$$d_0(s) = \frac{d_0}{s}$$

wherein $\omega_1$ and $\zeta_1$ represent a cutoff frequency and a damping factor, respectively, of second order lag elements of the rate sensor 74, and $d_0$ represents an offset voltage of a rate sensor 10. The formula $G_{11}(s)$ models the parasitic element as a second order LPF.

Furthermore, the inclinometer 72 possesses the following transfer function:

$$G_{20}(s)=K_2 \ (K_2\text{: constant})$$

In FIG. 19, $G_{21}(s)$ and $G_{22}(s)$ represent parasitic elements having an LPF characteristic and an influence of acceleration, respectively, and are expressed as follows:

$$G_{21}(s) = \frac{\omega_2^2}{s^2 + 2\zeta_2\omega_2 s + \omega_2^2}$$

$$G_{22}(s) = \frac{-(L/g)s^2 \cdot \omega_2^2 \cdot K_2}{s^2 + 2\zeta_2\omega_2 s + \omega_2^2}$$

wherein $\omega_2$ and $\zeta_2$ represent cutoff frequency and damping factor, respectively, of second order lag elements of the inclinometer 72, L represents a distance from the inclination center of the moving platform to the inclinometer 72 and g represents the acceleration of gravity. The formula $G_{21}(s)$ models the parasitic element as a second order LPF.

According to these formulas, the transfer functions of the rate sensor 74 and the inclinometer 72, containing the influences of the offset and acceleration, are expressed as follows:

$$G_{10}(s)\cdot G_{11}(s)+d_0(s)$$

$$G_{20}(s)\cdot G_{21}(s)+G_{22}(s)$$

The reciprocal combination filter 76 is a filter for reciprocally combining the outputs of the rate sensor 74 and the inclinometer 72 so that the frequency characteristic may not appear in the output $\theta_0(s)$ in the necessary frequency band.

Now, when the offset and the parasitic element are not considered, the transfer function of the rate sensor 74 is represented by the formula of $G_{10}(s)=K_1\cdot s$. Also, when the influence of the acceleration and the parasitic element are not considered, the transfer function of the inclinometer 72 is represented by the formula of $G_{20}(s)=K_2$. In order to reciprocally combine the outputs of both the members, in principle, it is necessary to meet the following relationship:

$$G_{rate}^{(0)}(s)+G_{incl}^{(0)}(s)=1$$

wherein $G_{rate}^{(0)}(s)$ is a transfer function including the rate sensor 74 and the reciprocal filter 82, and $G_{incl}^{(0)}(s)$ is a transfer function including the inclinometer 72 and the reciprocal filter 84.

The reciprocal filters 82 and 84 are connected in series to the rate sensor 74 and the inclinometer 72, respectively, and the adder 86 adds the outputs of both the reciprocal filters 82 and 84 to output the detection result $\theta_0(s)$. The transfer function $F_{rate}^{(0)}(s)$ of the reciprocal filter 82 and the transfer function $F_{incl}^{(0)}(s)$ of the reciprocal filter 84 are specifically determined as follows:

$$F_{rate}^{(0)}(s)=K_a/(s+\omega_a)$$

$$F_{incl}^{(0)}(s)=K_b/(s+\omega_a)$$

Now, when $K_a=1/K_1$ and $K_b=\omega_a/K_2$, the following formula is obtained:

$$K_a/(s+\omega_a)\cdot K_1\cdot s+K_b/(s+\omega_a)\cdot K_2=1$$

It is readily understood that the reciprocal combination is carried out.

However, the inclinometer 72 includes the pendulum for obtaining the standard in the gravity direction, as shown in FIG. 7. The error due to the influence of the acceleration (error due to $G_{22}(s)$ in the above-described example) becomes large. Furthermore, the rate sensor 74 has the offset, and its temperature drift is large ($d_0(s)$ in the above-described example). The inclination angle output error (offset error) caused by the offset of the rate sensor 74 is $DR_0^{(0)}=d_0/(K_1\cdot\omega_a)$ as the limit value of $s\rightarrow 0$ of $s\cdot d_0(s)\cdot G_{10}(s)$ according to the final value theorem. A presently available low cost vibration gyro type rate sensor has characteristics such as $K_1=1.26$ (V/rad/sec) and $d_0=-0.2$ to 0.2 (V) (by temperature), and thus there is a practical problem of $DR_0^{(0)}$ except the case of using within a thermostatic chamber.

Figure 20:
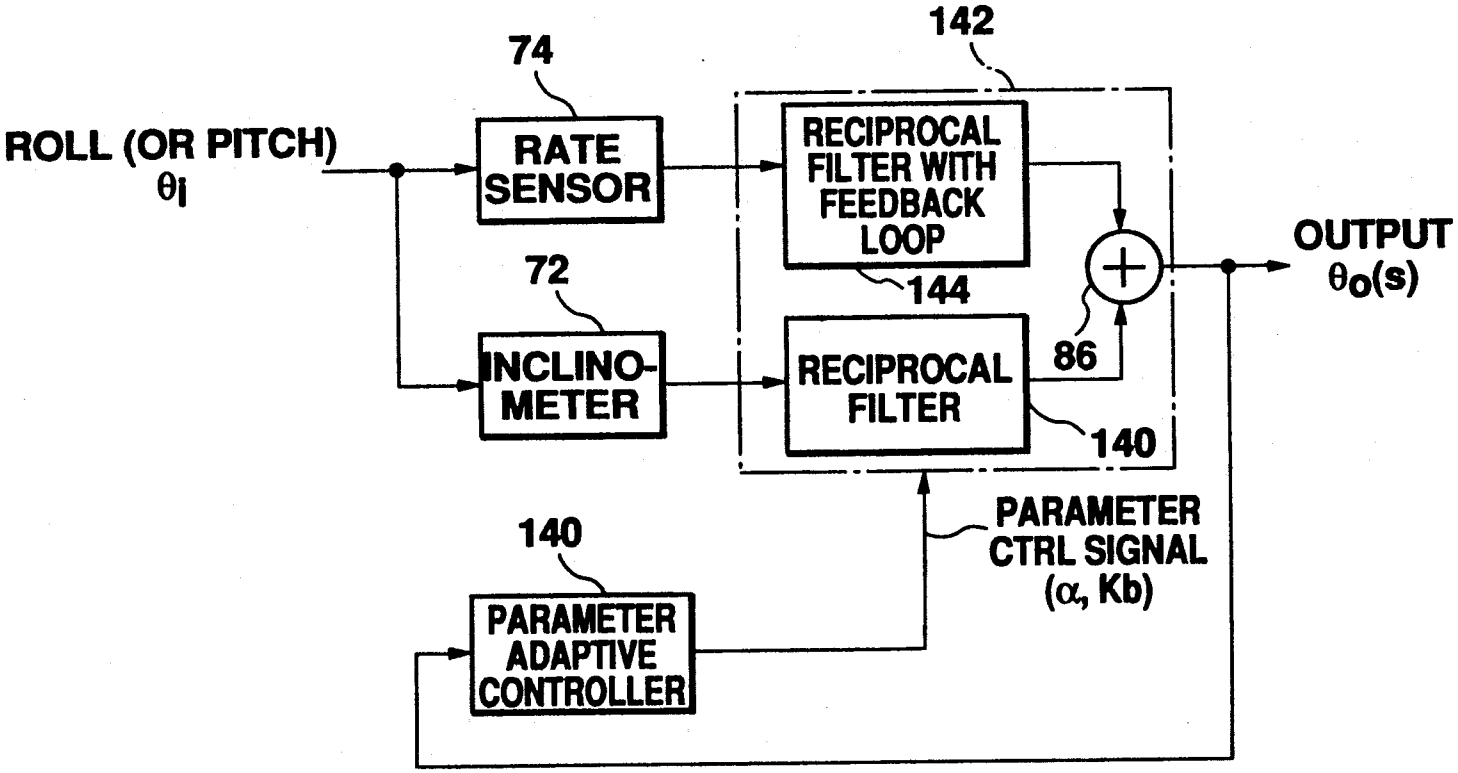
FIG. 20 is a block diagram of a uniaxial inclination sensor of a fifth embodiment of a stabilized antenna system according to the present invention.
Figure 21:
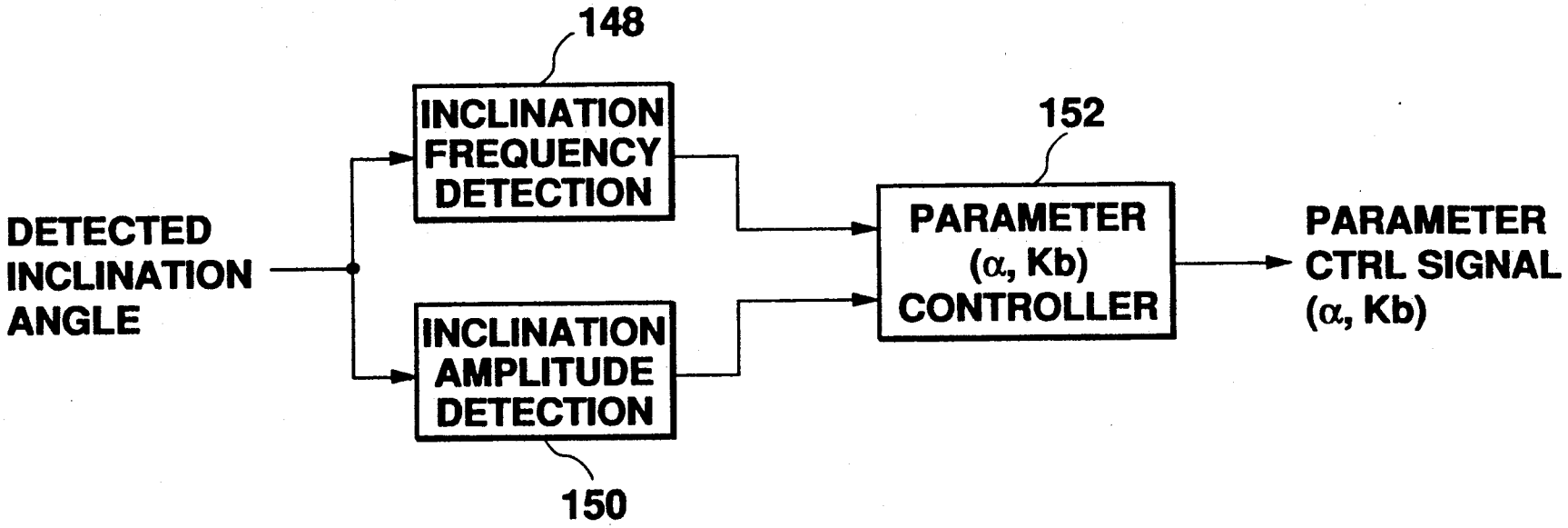
FIG. 21 is a block diagram of a parameter adaptive controller shown in FIG. 20.
Figure 22:
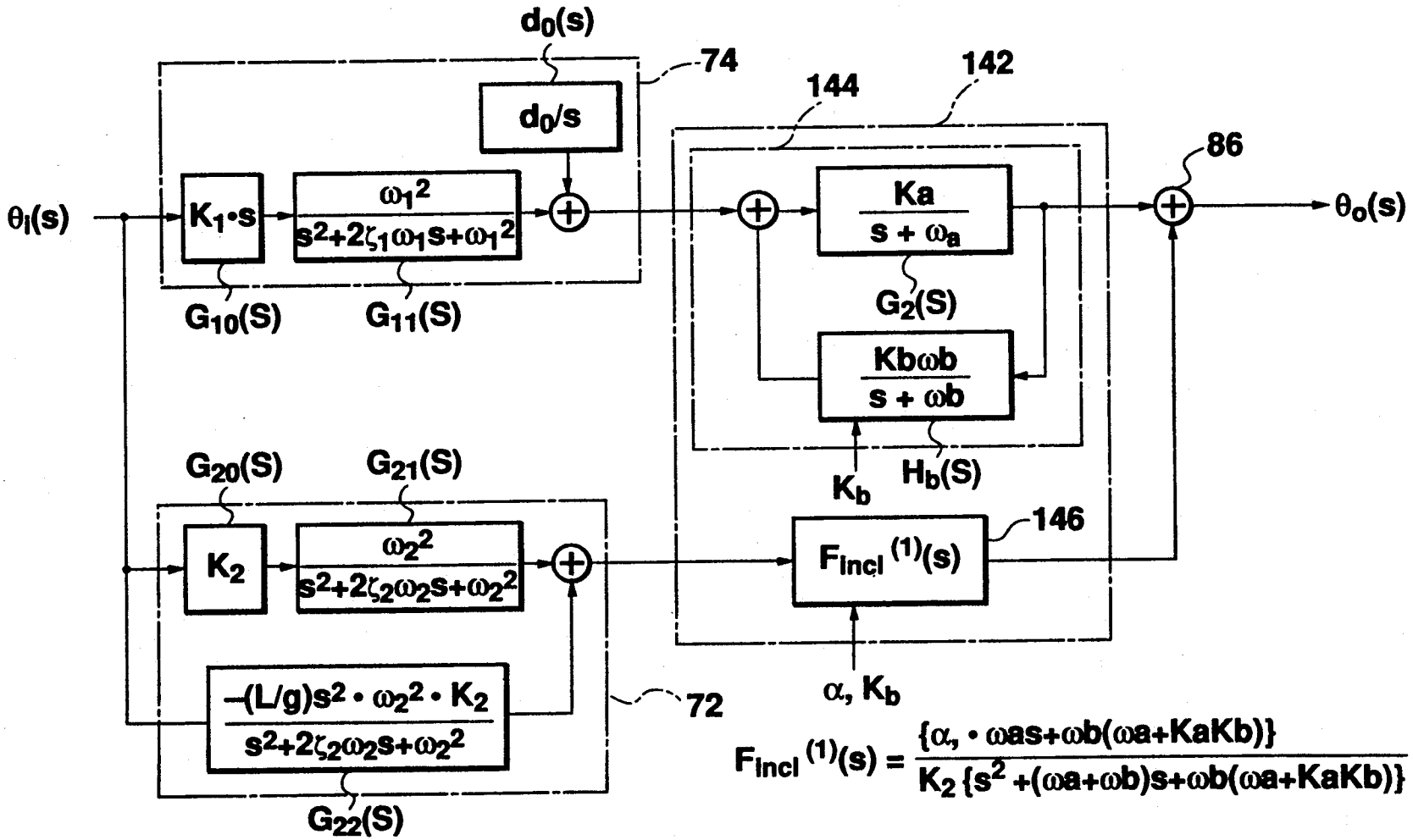
FIG. 22 is a block diagram showing a transfer function model of the uniaxial inclination sensor shown in FIG. 20.

In FIG. 20, there is shown the structure of a uniaxial inclination sensor of the fifth embodiment of a stabilized antenna system according to the present invention. FIG. 21 shows the structure of a parameter adaptive controller shown in FIG. 20, and FIG. 22 shows a transfer function model of the uniaxial inclination sensor shown in FIG. 20.

In this embodiment, as shown in FIG. 20, the uniaxial inclination sensor 52 includes an inclinometer 72, a rate sensor 74, a parameter adaptive controller 140 and a parameter adaptive reciprocal combination filter 142 having a reciprocal filter with a feedback loop 144, a reciprocal filter 146 and an adder 86.

The reciprocal filter with the feedback loop 144 and the reciprocal filter 146 are connected to the rear stages of the rate sensor 74 and the inclinometer 72, respectively, and the adder 86 adds the outputs of both the reciprocal filter with the feedback loop 144 and 146.

The points different from the structure of the parameter adaptive reciprocal combination filter 142 from the first to fourth embodiments are as follows. First, the reciprocal filter 144 includes the feedback loop so as to enable reduction of an offset error $DR_0^{(1)}$, as shown in FIG. 22.

As shown in FIG. 22, when a transfer function of the feedback loop of the reciprocal filter 144 is defined as follows:

$$H_b(s)=K_b\omega_b/(s+\omega_b)$$

a transfer function $F_{rate}^{(1)}(s)$ of the reciprocal filter 144 is obtained as the following combination value:

$$\begin{aligned} F_{rate}^{(1)}(s) &= G_2(s)/(1+G_2(s)\cdot H_b(s)) \\ &= \frac{K_a/(s+\omega_a)}{1+\{K_a/(s+\omega_a)\}\{K_b\omega_b/(s+\omega_b)\}} \\ &= \frac{K_a(s+\omega_a)}{s^2+(\omega_a+\omega_b)s+\omega_b(\omega_a+K_aK_b)} \end{aligned}$$

wherein $\omega_b$ represents a cutoff frequency of the feedback loop and $K_b$ represents a feedback gain factor of the feedback loop, of the following transfer function $$G_2(s)=K_a/(s+\omega_a)$$

and the transfer function $H_b(s)$ of the feedback loop. $K_b$ is controlled by the parameter adaptive controller 140 depending on the conditions of the inclination, as hereinafter described in detail.

This transfer function $F_{rate}^{(1)}(s)$ indicates that the reciprocal filter 144 functions as a second order bandpass filter.

The error of $\theta_0(s)$ due to the offset of the rate sensor 74, that, is, the offset error $DR_0^{(1)}$ is obtained from $F_{rate}^{(1)}(s)$ by the final value theorem as follows.

$$DR_0^{(1)}=d_0/(K_1\cdot\omega_a+K_b)$$

It can be understood from this formula that the offset error $DR_0^{(1)}$ becomes small by increasing the feedback gain factor $K_b$ of the feedback loop. That is, in this embodiment, the offset error $DR_0(1)$ can be reduced by providing the feedback loop with feedback gain factor $K_b$ in the reciprocal filter 144.

In this embodiment, the transfer function of the reciprocal filter 146 is different from that of the filter 82 of the first to fourth embodiments, as shown in FIG. 6.

In order to satisfy the reciprocity in a predetermined frequency band, it is required to satisfy the following relationship:

$$K_1\cdot s\cdot F_{rate}^{(1)}(s)+K_2\cdot F_{incl}^{(1)}(s)=1$$

$F_{incl}^{(1)}(s)$: a transfer function of the reciprocal filter 146

However, at this time, the parasitic elements of the rate sensor 74 and the inclinometer 72, the drift of the rate sensor 74, and the influence of the acceleration in the inclinometer 72 are neglected.

On the other hand, since the transfer function $F_{rate}^{(1)}(s)$ of the reciprocal filter 144 is expressed by the formula, as described above, the transfer function $F_{incl}^{(1)}(s)$ of the reciprocal filter 146 can be expressed by the modification of the above-described formulas as follows:

$$F_{incl}^{(1)}(s)=\frac{\omega_a s+\omega_b(\omega_a+K_aK_b)}{K_2\{s^2+(\omega_a+\omega_b)s+\omega_b(\omega_a+K_aK_b)\}}$$

In this formula, a 1st order term of the Laplace operator s appears in the numerator. From this term, the inclination error results.

That is, the inclination acceleration error is an error appearing in the output $\theta_0(s)$ which is influenced by the acceleration due to the inclinometer 72. When the period of inclination is short and the installation height L is large, it is considered that the influence of $G_{22}(s)$ is emphasized by the term of the 1st order Laplace operator s $\omega_a\cdot s$ and thus the error becomes large.

Accordingly, in this embodiment, for reducing the contributory part of the term of the 1st order Laplace operator s, a correction factor $\alpha$ ($\alpha<1$) is introduced in the transfer function $F_{incl}^{(1)}(s)$ as follows.

$$F_{incl}^{(1)}(s)=\frac{\alpha\cdot\omega_a s+\omega_b(\omega_a+K_aK_b)}{K_2\{s^2+(\omega_a+\omega_b)s+\omega_b(\omega_a+K_aK_b)\}}$$

As described above, by enlarging the feedback gain factor $K_b$, the offset error is reduced, and by introducing the correction factor $\alpha$, the inclination acceleration error is reduced. However, when the feedback gain factor $K_b$ is enlarged, the inclination acceleration error is enlarged regardless of the correction factor $\alpha$. Hence, in order to reduce both the offset error and the inclination acceleration error at the same time, it is necessary to carry out an adaptive control of the correction factor $\alpha$ and the feedback gain factor $K_b$.

In this embodiment, for the adaptive control, the parameter adaptive controller 140 is provided. The parameter adaptive controller 140 detects the frequency and amplitude of the inclination from the output $\theta_0(s)$ of the parameter adaptive reciprocal combination filter 142 and outputs a parameter control (ctrl) signal ($\alpha$, $K_b$) on the basis of the detection result to the parameter adaptive reciprocal combination filter 142. In the parameter adaptive reciprocal combination filter 142, a parameter ($\alpha$, $K_b$) is switched depending on the parameter control signal ($\alpha$, $K_b$) fed from the parameter adaptive controller 140.

In FIG. 21, there is shown one embodiment of the parameter adaptive controller 140 shown in FIG. 20. The parameter adaptive controller 140 includes an inclination frequency detector 148, an inclination amplitude detector 150 and a parameter ($\alpha$, $K_b$) controller 152. The inclination frequency detector 148 and the inclination amplitude detector 150 detect the respective frequency and amplitude of the inclination $\theta_0(s)$ from the parameter adaptive reciprocal combination filter 142, and output the detection results to the parameter ($\alpha$, $K_b$) controller 152. This frequency and amplitude detection is executed by using, for example, the FFT (fast Fourier transform) or the DFT (discrete Fourier transform). The method for obtaining the frequency and the amplitude of the input signal by the FFT or the DFT is a known algorithm.

The parameter ($\alpha$, $K_b$) controller 152 controls the parameter ($\alpha$, $K_b$) to the corresponding value according to the frequency and the amplitude of the inclination, detected by the inclination frequency detector 148 and the inclination amplitude detector 150.

By this parameter control, both the offset error and the inclination acceleration error can be reduced at the same time. In this instance, when the correction factor $\alpha$ becomes far less than one due to the adaptive control of the correction factor $\alpha$, the reciprocity at a low frequency is partially destroyed. Accordingly, there is a possibility of increasing the error at the low frequency, but this can be controlled to a negligible amount compared with the error reduction by the correction factor $\alpha$.

Furthermore, in practice, the reciprocity is disturbed due to a phase delay of the rate sensor 74 in the high range (around one Hz or more, when the system mounted on the ship and its inclination is detected). Hence, the characteristics of the rate sensor 74 should be checked depending on uses. In this embodiment, it is assumed that the reciprocity in the high range can be almost satisfied in the necessary range for its use, and the terms such as a reciprocal filter and the like are still used in the following description. A model of the present embodiment will be called a reciprocal model. Also, a case of $\alpha=1$ will be called a complete reciprocal model, and a case of $\alpha\neq1$ will be called an incomplete reciprocal model.

Prior to carrying out the adaptive control of the correction factor $\alpha$ and the feedback gain factor $K_b$, it is necessary to know how the errors change by the variations of the correction factor $\alpha$ and the feedback gain factor $K_b$. That is, by conducting a simulation or the like, the contents (the switch stage number, the value and the like) of the adaptive control of the correction factor $\alpha$ and the feedback gain factor $K_b$ are determined so that the errors may be the minimum values.

Figure 23A:
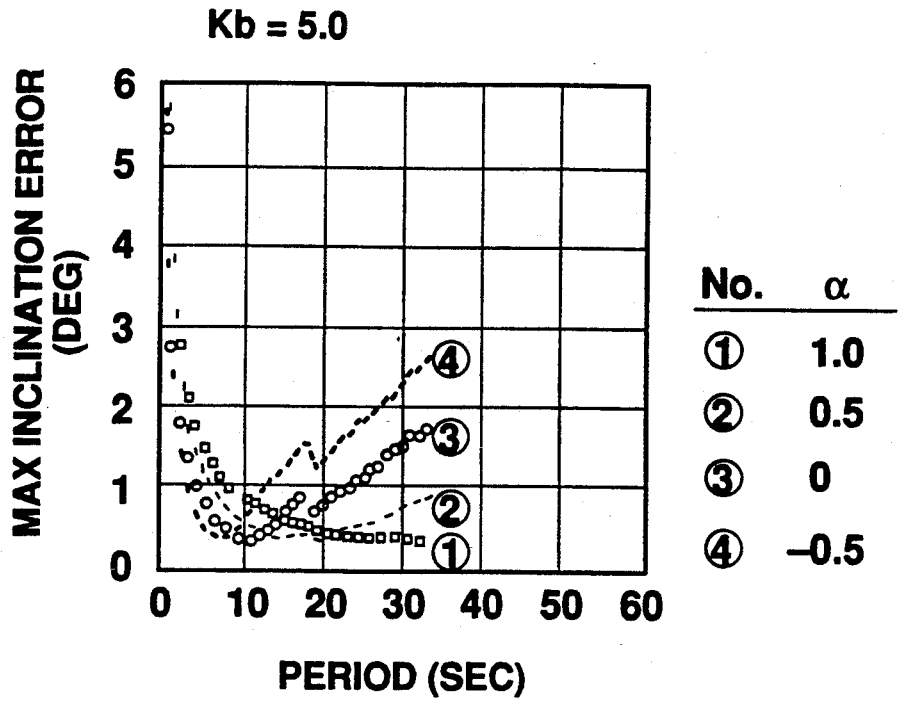
FIGS. 23A, 23B and 23C are graphical representations of a simulation result of an inclination acceleration error, when Kb=5.0, 10.0 and 15.0, respectively, obtained in the fifth embodiment of the stabilized antenna system according to the present invention.
Figure 23B:
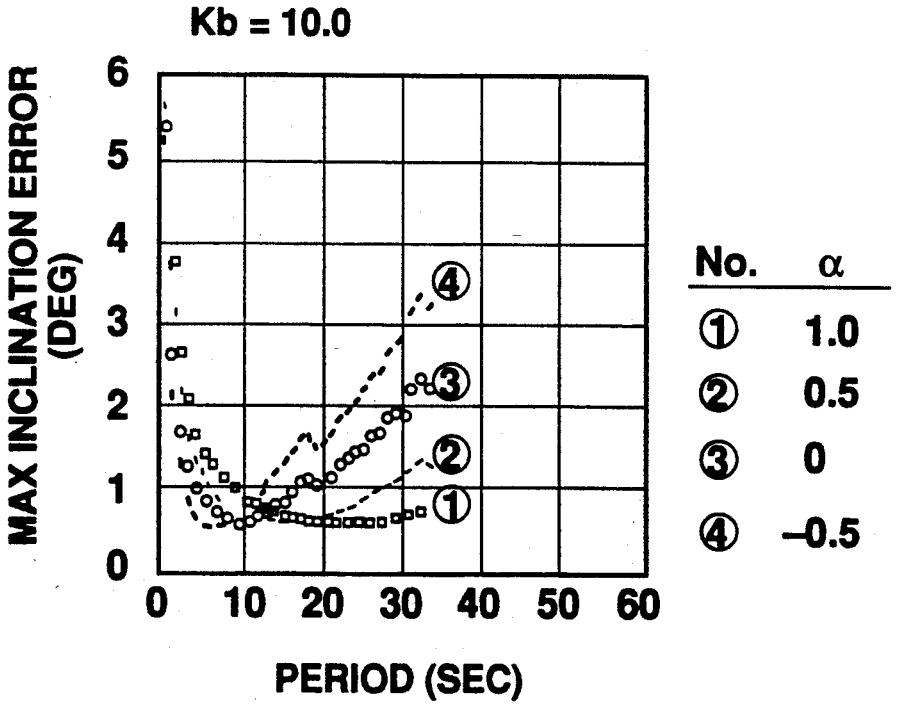
Figure 23C:
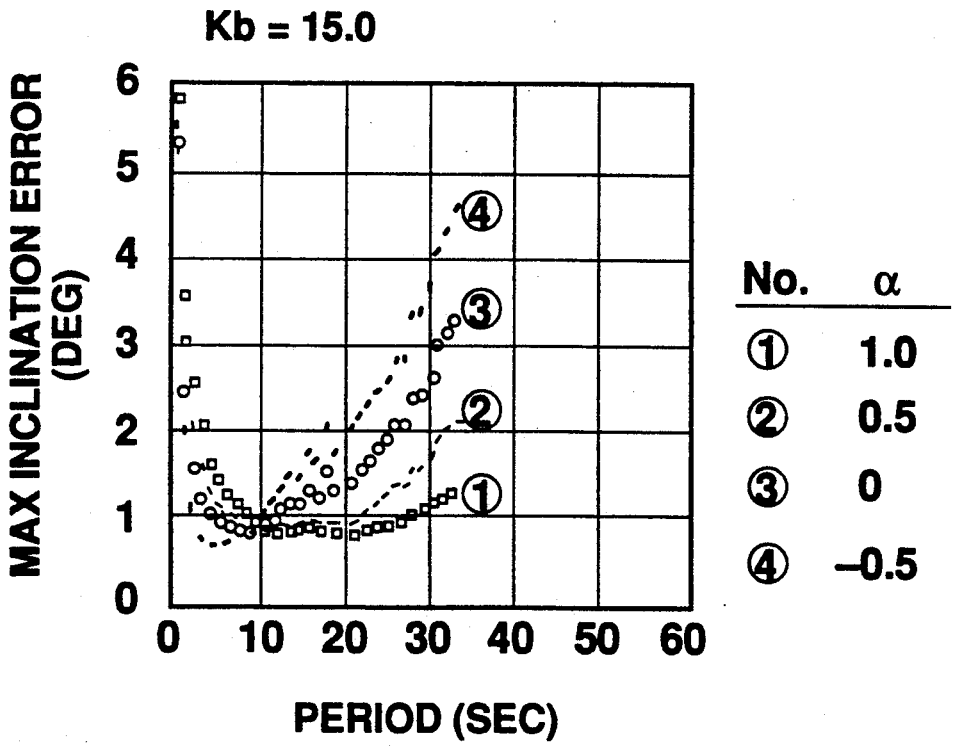

FIGS. 23A to 23C show the simulation results of the inclination acceleration error. In FIGS. 23A to 23C, as to a sine wave of an inclination amplitude of 20 (deg) and an inclination period of 1 to 33 (sec), an inclination acceleration error is obtained. The conditions are determined as follows. That is, the feedback gain factor $K_b=5.0$ (FIG. 23A), 10.0 (FIG. 23B) and 15.0 (FIG. 23C), the installation height $L=20$ (m) of the inclinometer 72, $f1=\omega1/2\pi=7.0$ (Hz), $\zeta1=1.0$, $f2=\omega2/2\pi=1.0$ (Hz), $\zeta2=1.0$, and the correction factor $\alpha=-0.5$, 0, 0.5 and 1.0.

It is understood from FIGS. 23A to 23C that, when the inclination period is short, the correction factor $\alpha$ is smaller as compared with 1, the inclination acceleration error is small, and, as the correction factor $\alpha$ is closer to 1, the inclination acceleration error becomes large. Furthermore, as the feedback gain factor $K_b$ becomes large, the inclination acceleration error becomes large.

Figure 24:
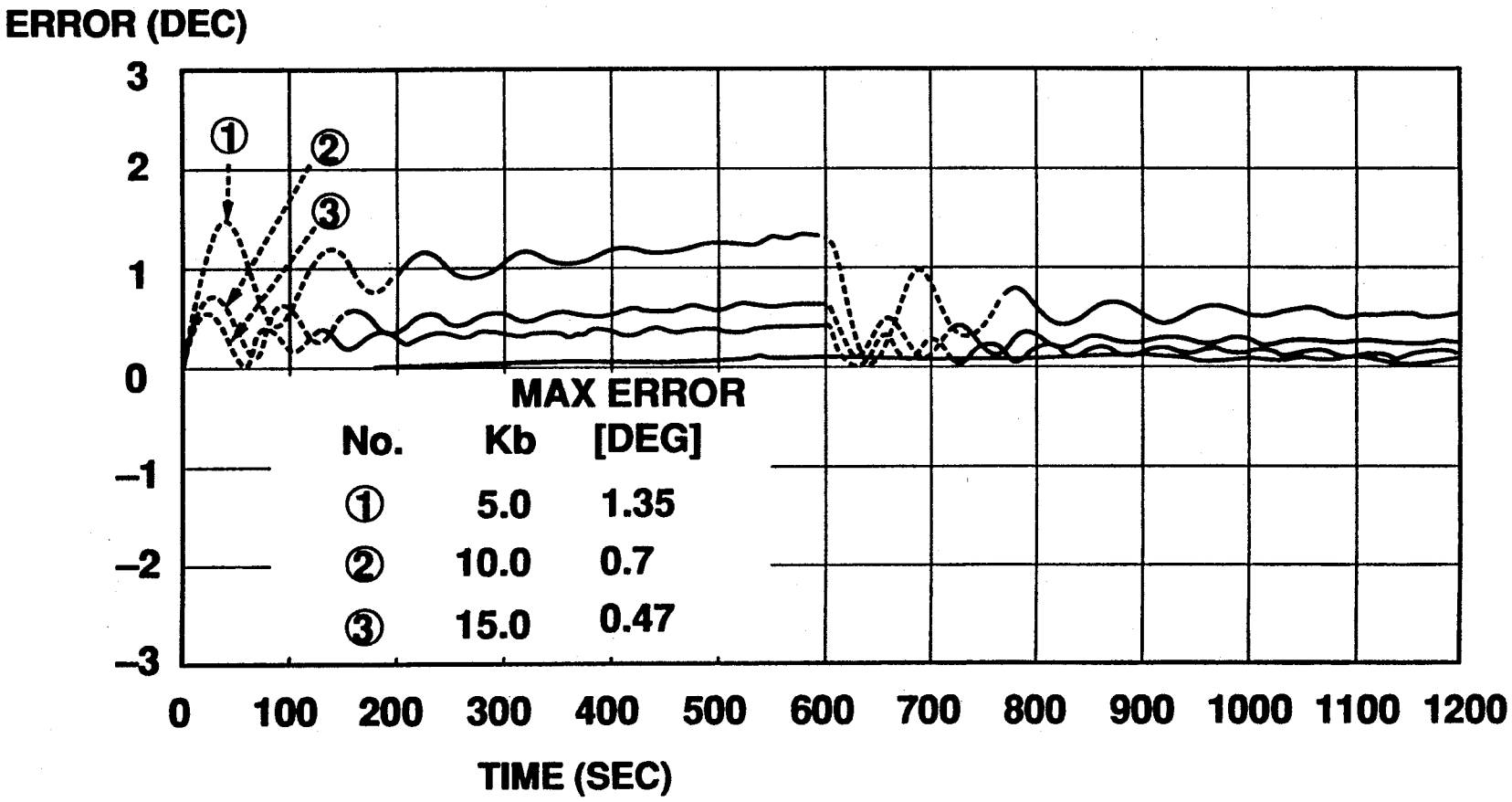
FIG. 24 is a graphical representation of a simulation result of a drift error obtained in the fifth embodiment of the stabilized antenna system according to the present invention.

FIG. 24 shows the simulation result of a ramp response (an error due to the drift of an offset of the rate sensor 74, that is, a drift error) of the transfer function $F_{rate}^{(1)}(s)$. A used ramp input is started from 0 (V) and reaches 50 (mV) in 10 (min) (corresponding to an angular speed of approximately 2 (deg/sec)), and the ramp response of three cases of feedback gain factor $K_b=5.0$, 10.0 and 15.0 is obtained. It is understood from FIGS. 23A to 23C that as the feedback gain factor $K_b$ is enlarged, the drift error can be diminished.

From these simulation results, for example, the adaptive control for the correction factor $\alpha$ and the feedback gain factor $K_b$ can be determined as follows.

Figure 25:
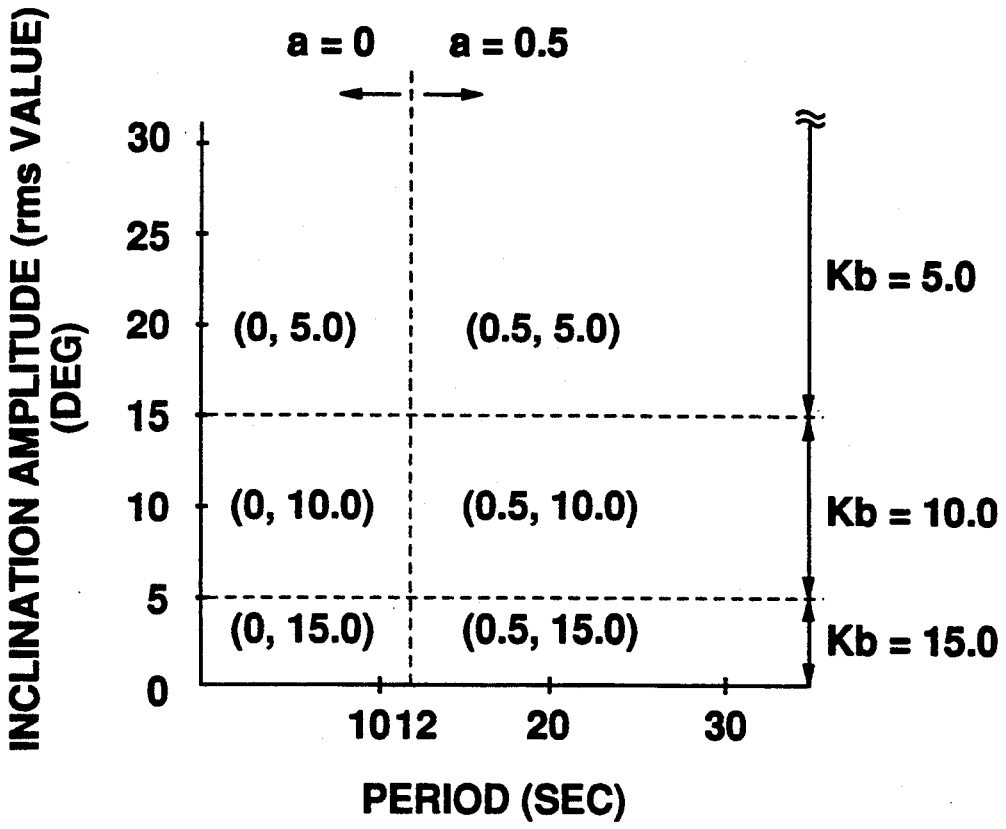
FIG. 25 is a graphical representation showing an adaptive control in the fifth embodiment of the stabilized antenna system according to the present invention.

FIG. 25 shows one example of the adaptive control, in which a correction factor $\alpha$ and a feedback gain factor $K_b$ of a parameter ($\alpha$, $K_b$) are varied. In this instance, the parameter ($\alpha$, $K_b$) controller 152 controls the correction factor $\alpha$ by switching the correction factor $\alpha$ at the following two stages depending on the frequency (1/period of inclination) for the inclination, detected by the inclination frequency detector 148.

Period of inclination $\geqq$ 12 (sec) $\alpha=0.5$

Period of inclination $<$ 12 (sec) $\alpha=0$

The parameter ($\alpha$, $K_b$) controller 152 also controls the feedback gain factor $K_b$ by switching the feedback gain factor $K_b$ at the following three stages depending on the amplitude (rms value) of the inclination, detected by the inclination amplitude detector 150.

| | |
|---|---|
| Amplitude of inclination $<$ 5 (deg) | $K_b = 15.0$ |
| 5 (deg) $\leqq$ amplitude of inclination $<$ 15 (deg) | $K_b = 10.0$ |
| Amplitude of inclination $\geqq$ 15 (deg) | $K_b = 5.0$ |

In this case, as regards the determination of the feedback gain factor $K_b$, the cutoff frequencies $\omega_a$ and $\omega_b$ and the like, it is not sufficient by the aforementioned simplified transfer function formulas, and it is necessary to determine by carrying out a time series analysis using more detailed formulas.

First, when the transfer function $G_{11}(s)$ of the parasitic element is considered, the transfer function $G_{rate}^{(1)}(s)$ of a combination system of the rate sensor 74 and the reciprocal filter 144, hereinafter referred to as a rate sensor system is expressed from $$G_{rate}^{(1)}(s)=G_{10}(s)\cdot G_{11}(s)\cdot F_{rate}^{(1)}(s)$$

as follows:

$$G_{rate}^{(1)}(s) = \frac{K_1\omega_1^2 s}{s^2 + 2\zeta_1\omega_1 s + \omega_1^2}.$$

-continued $$\frac{K_a(s+\omega_b)}{s^2+(\omega_a+\omega_b)s+\omega_b(\omega_a+K_aK_b)}$$

Furthermore, considering the transfer function $G_{21}(s)$ of the parasitic element and the transfer function $G_{22}(s)$ of the acceleration, the transfer function $$G_{incl}^{(1)}(s)=55\ G_{20}(s)\cdot G_{21}(s)+G_{22}(s)\}F_{incl}^{(1)}(s)$$

of a combination system of the inclinometer 72 and the reciprocal filter 146, hereinafter referred to as an inclination sensor system, is expressed as follows:

$$G_{incl}^{(1)}(s)=\frac{K_2\{1-(L/g)s^2\}\omega_2^2}{s^2+2\zeta_2\omega_2 s+\omega_2^2}\cdot\frac{\alpha\omega_a s+\omega_b(\omega_a+K_aK_b)}{s^2+(\omega_a+\omega_b)s+\omega_b(\omega_a+K_aK_b)}$$

Therefore, the total transfer function $G_{total}^{(1)}(s)$ of the circuit is expressed as follows:

$$G_{total}^{(1)}(s)=G_{rate}^{(1)}(s)+G_{incl}^{(1)}(s)=\frac{r_2 s(s+\omega_b)}{(s^2+r_1 s+r_2)(s^2+b_1 s+b_2)}+\frac{a_0 s^3+a_1 s^2+a_2 s+a_3}{(s^2+p_1 s+p_2)(s^2+b_1 s+b_2)}$$

wherein $r_1=2\zeta_1\omega_1$, $r_2=\omega_1^2$,
$P_1=2\zeta_2\omega_2$, $P_2=\omega_2^2$,
$b_1=\omega_a+\omega_b$, $b_2=\omega_b(\omega_a+K_aK_b)$,
$a_0=\alpha K_{La}p_2\omega_a$, $a_1=K_{La}p_2b_2$, $a_2=\alpha p_2\omega_a$,
$a_3=p_2b_2$, $K_{La}=-L/g$.

In this embodiment, as described above, the offset error, the drift error and the inclination acceleration error can be reduced.

First, when the offset error is compared with the example in FIG. 5, in FIG. 5; offset error $DR_0(0)$ = 0.126 (rad) = 7.24 (deg)
in FIG. 20; offset error $DR_0(1)$ = 0.010 (rad) = 0.57 (deg)

the offset error is remarkably reduced. This data obtained under the following conditions:

$K_1=1.26$ (V/rad/sec)
$d_0=0.1$ (V)
$\omega_a^{(0)}=2\pi\times0.1$ (rad), $\omega_a^{(1)}=2\pi\times0.002$ (rad)
$K_b=10.0$ Hence, in this embodiment, by the feedback loop, the offset error can be reduced, and the rate sensor 74, having a large offset error, can be used.

Furthermore, relating to the drift error and the inclination acceleration error, as apparent from the results shown in FIGS. 23A to 23C and FIG. 24, by the adaptive control of the correction factor $\alpha$ and the feedback gain factor $K_b$, they can be reduced as a whole.

Figure 26:
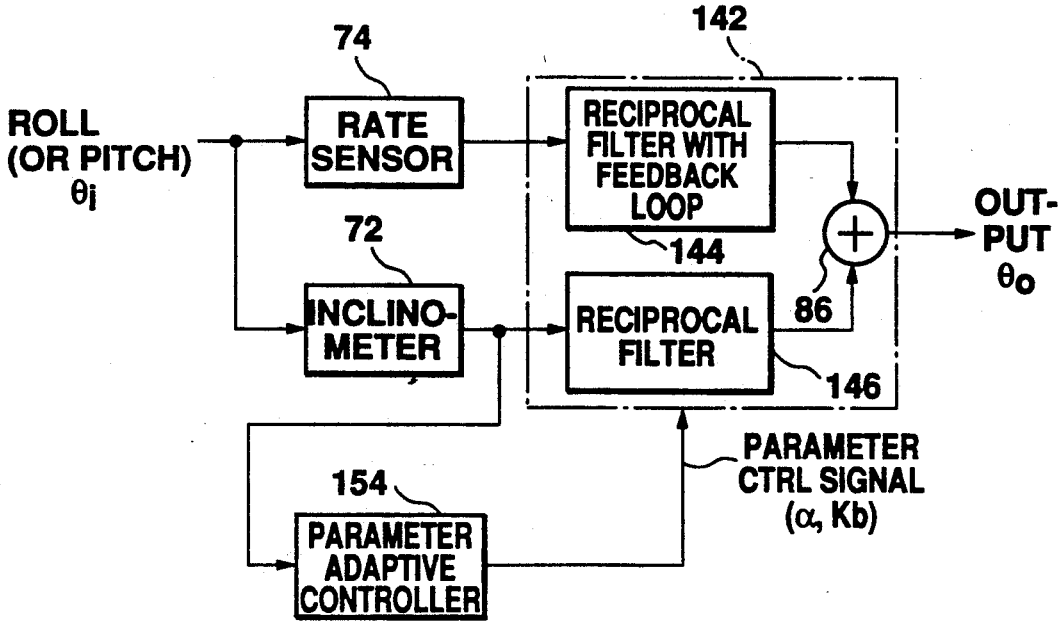
FIG. 26 is a block diagram of a uniaxial inclination sensor of a sixth embodiment of a stabilized antenna system according to the present invention.

In FIG. 26, there is shown a structure of a uniaxial inclination sensor of the sixth embodiment of a stabilized antenna system according to the present invention. In this embodiment, a parameter adaptive controller 154 does not detect the frequency and amplitude of the inclination from the output $\theta_0$ of the parameter adaptive reciprocal combination filter 142, but detects the same from the output of the inclinometer 72, to output the parameter control signal ($\alpha$, $K_b$) to the parameter adaptive reciprocal combination filter 142. The function of the parameter adaptive controller 154 is almost the same as the parameter adaptive controller 140 of the fifth embodiment shown in FIG. 20. In this embodiment, of course, the same effects and advantages as those of the above-described embodiments can be obtained.

Figure 27:
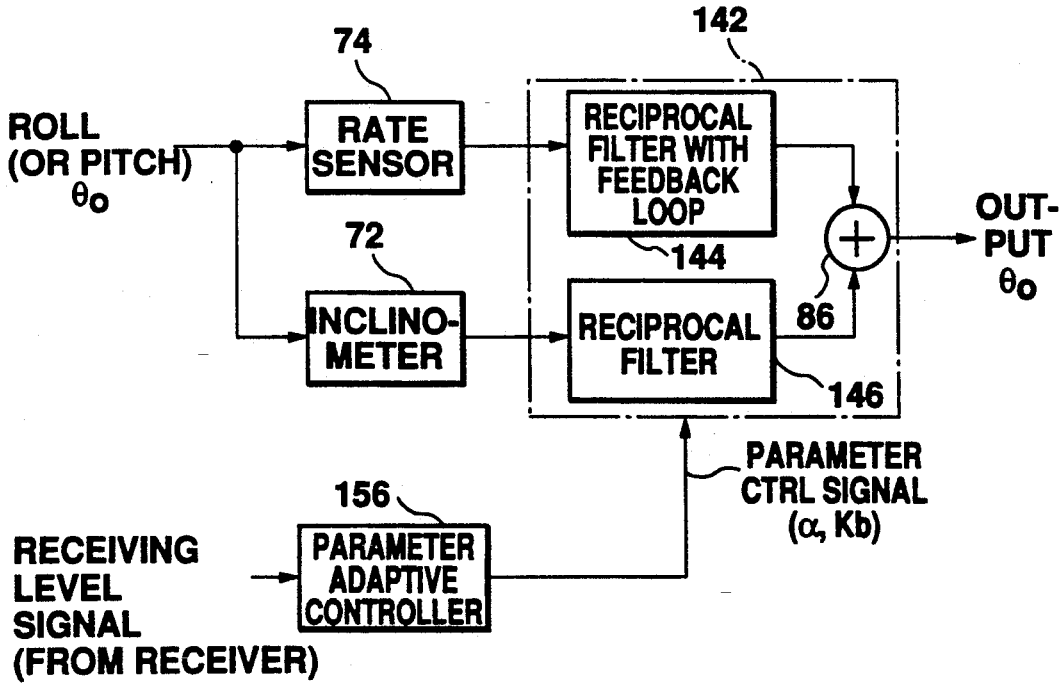
FIG. 27 is a block diagram of a uniaxial inclination sensor of a seventh embodiment of a stabilized antenna system according to the present invention.

In FIG. 27, there is shown a structure of a uniaxial inclination sensor 52 of the seventh embodiment of a stabilized antenna system according to the present invention. In this embodiment, a parameter adaptive controller 156 inputs a receiving level signal from a receiver and outputs a parameter control signal ($\alpha$, $K_b$) to the parameter adaptive reciprocal combination filter 142 to properly control feedback gain factor $K_b$ and the correction factor $\alpha$.

In this embodiment, the receiving level signal output from this receiver exhibits the signal level received from the communication satellite. The parameter adaptive controller 156 executes the step track on the basis of the receiving level signal.

That is, the parameter adaptive controller 156 generates the step track signal having a minute value and determines the sign(+/−) of this signal, corresponding to the direction, so that the receiving level may be increased to output as a parameter control signal ($\alpha$, $K_b$). By this signal, the values of the correction factor $\alpha$ and the feedback gain factor $K_b$ are gradually increased or decreased, and as a result, the output $\theta_0$, having a small error, can be obtained from the parameter adaptive reciprocal combination filter 142.

Figure 28:
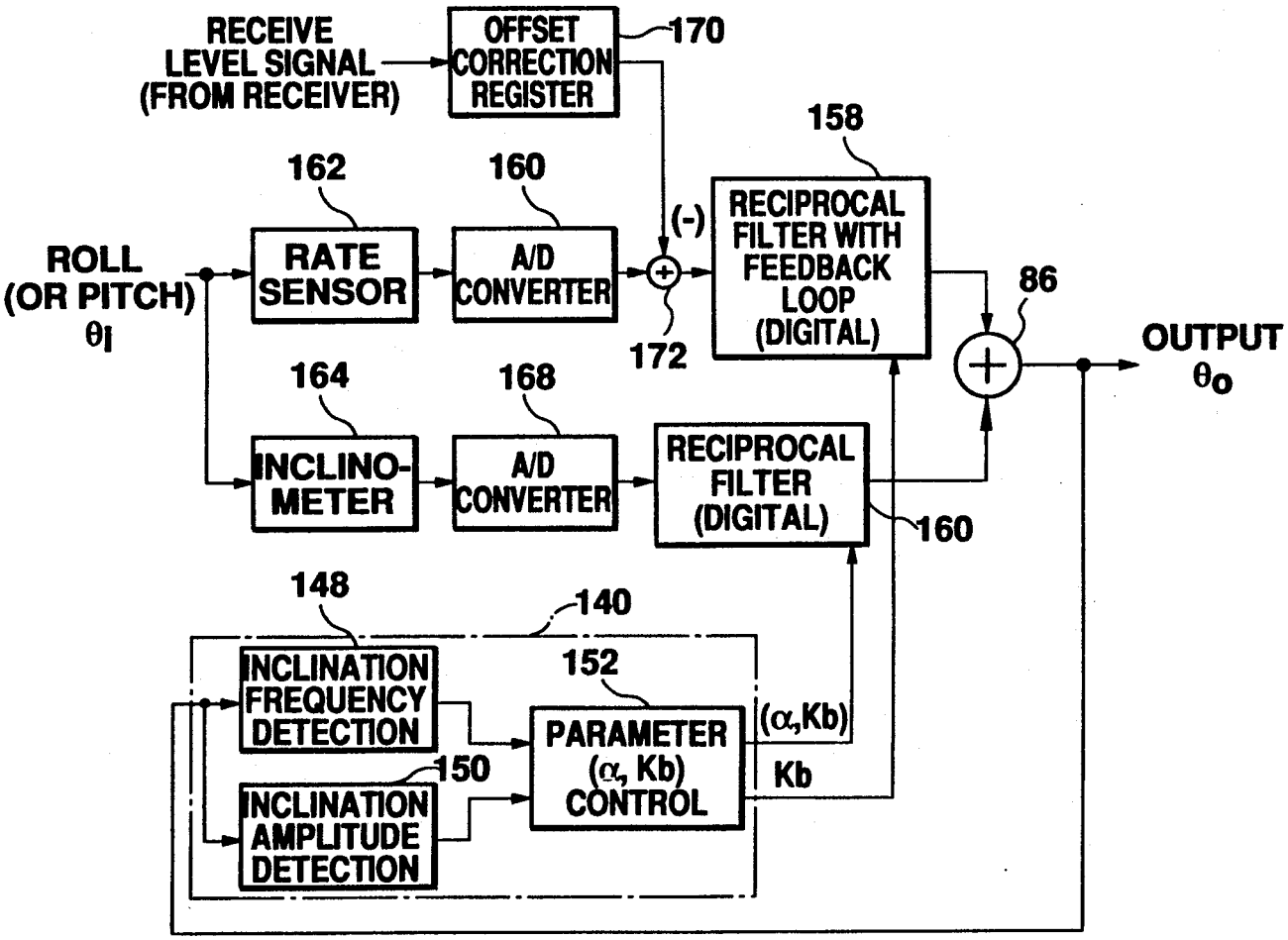
FIG. 28 is a block diagram of a uniaxial inclination sensor of an eighth embodiment of a stabilized antenna system according to the present invention.

In FIG. 28, there is shown a structure of a uniaxial inclination sensor 52 of the eighth embodiment of a stabilized antenna system according to the present invention. In this embodiment, two reciprocal filters 158 and 160 are implemented as digital filters, and hence to output sides of a rate sensor 162 and an inclinometer 164, two A/D (analog-digital) converters 166 and 168 are also connected. The output of the A/D converter 166 is fed to the reciprocal filter 158 via an adder 172, and the output of the A/D converter 168 is input to the reciprocal filter 160. An offset correction register 170 for correcting the offset of the output of the rate sensor 162 is coupled to the adder 172. A parameter adaptive controller 140 has almost the same structure as the fifth embodiment shown in FIGS. 20 and 21.

In this embodiment, in case where the reciprocal filters 158 and 160 are implemented as the digital filters, the parameter control can be readily carried out (the control of the correction factor $\alpha$ and the feedback gain factor $K_b$ is relatively easy). In this embodiment, an implementation by digital filters can be carried out by a bilinear transformation as follows:

First, an implementation of the reciprocal filter 158 will be described. By using an operator $u=z^{-1}$ representing a unit time T (one bit) of delay, a bilinear transformation of a transfer function $F_{rate}^{(1)}(s)$ using a Laplace operator where $s=h(1-u)/(1+u)$ and $h=2/T$ is carried out to obtain the following formula:

$$F_{rate}^{(1)}(s) = (H_0\cdot u^2+H_1\cdot u+H_2)/(N_0\cdot u^2+N_1\cdot u+N_2) = Z(u)/R(u)$$

wherein

R(u): input series to reciprocal filter 158

Z(u): output series from reciprocal filter 158

$H_0=K_a(-h+\omega_a)$ $H_1=2K_a107_b$ $H_2=K_a(h+\omega_b)$ $N_0=h^2-b_1h+b_2$ $N_1=-2h^2+2b_2$ $N_2=h^2+b_1h+b_2$ In this formula, by expressing that $R(u)\cdot u^1=R_{-1}$ and $Z(u)\cdot u^1=Z_{-1}$, the output series Z(u) is expressed in the following difference equation:

$$Z(u)=H_{00}R_{-2}+H_{10}R_{-1}+H_{20}R(u)-(N_{00}R_{-2}+N_{10}R_{-1}+N_{20}R(u))$$

wherein $H_{00}=H_0/N_2$ $H_{10}=H_1/N_2$ $H_{20}=H_2/N_2$ $N_{00}=N_0/N_2$ $N_{10}=N_1/N_2$ $N_{20}=N_2/N_2$ This difference equation can be readily implemented by a logic circuit or a program for a microprocessor.

Similarly, a bilinear transformation of a transfer function $F_{incl}^{(1)}(s)$ of the reciprocal filter 160 is carried out to obtain the following formula:

$$\begin{aligned} F_{incl}^{(1)}(s) &= (M_0\cdot u^2+M_1\cdot u+M_2)/(N_0\cdot u^2+N_1\cdot u+N_2) \\ &= Y(u)/X(u) \end{aligned}$$

wherein

X(u): input series to reciprocal filter 160

Y(u): output series from reciprocal filter 160

$M_0=(-\alpha\omega_a h+b_2)/K_2$ $M_1=2b_2/K_2$ $M_2=(\alpha\omega_a h+b_2)/K_2$ In this formula, by expressing that $X(u)\cdot u^1=X_{-1}$ and $Y(u)\cdot u^1=Y_{-1}$, the output series Y(u) is expressed in the following difference equation:

$$Y(u)=M_{00}R_{-2}+M_{10}R_{-1}+M_{20}R(u)-(N_{00}R_{-2}+N_{10}R_{-1}+N_{20}R(u))$$

wherein $M_{00}=M_0/N_2$ $M_{10}=M_1/N_2$ $M_{20}=M_2/N_2$

This difference equation can be readily implemented by a logic circuit or a program for a microprocessor as well.

Furthermore, in this embodiment, the adder 172 subtracts the content of the offset correct register 170 from the output of the A/D converter 166 and outputs the subtracted value to the reciprocal filter 158. The offset correct register 170 stores the offset of the rate sensor 162, and, when the content of the offset correct register 170 is subtracted from the output of the A/D converter 166, the offset corrected value is input to the reciprocal filter 158. As a result, the error can be further reduced.

In the offset correct register 170, the receive level signal is input from the receiver. The offset correct register 170 is provided with the step track function, and thus gradually increases or decreases the offset value depending on the value change of the receiving level signal. As an initial value to be set to the offset correct register 170, a normal temperature value can be preferably used.

As described above, when the offset correct register 170 is used, the feedback gain factor $K_b$ can be settled to a relatively small value, for example, $K_b \leqq 5$.

Accordingly, in this embodiment, since the reciprocal filters 158 and 160 are implemented as the digital filters, the feedback gain factor $K_b$ and the correction factor $\alpha$ can be relatively easily controlled, and further, since by the step track in the offset correct register 170, not only the offset error can be reduced but also the feedback gain factor $K_b$ can be determined to be relatively small, the inclination acceleration error can be also reduced. Furthermore, by using the offset correct register 170, the improvement of the tracking function by the array antenna can be performed.

Although the present invention has been described in its preferred embodiments with reference to the accompanying drawings, it it readily understood that the present invention is not restricted to the preferred embodiments and that various changes and modifications can be made by those skilled in the art without departing from the spirit and scope of the present invention.

For instance, in the example of the control shown in FIG. 25, the correction factor $\alpha$ and the feedback gain factor $K_b$ are switched into 2 to 3 stages. As shown in this example, the adaptive control according to the present invention does not necessarily mean only a high level adaptive algorithm, and control such as switching into 2 to 3 steps can be sufficiently practicable.

In the above-described embodiments, although the adaptive control of the correction factor $\alpha$ and the feedback gain factor $K_b$ have been described with reference to the $\alpha$-$K_b$ adaptation model, by an $\alpha$ adaptation model for adaptively switching or controlling only the correction factor $\alpha$, the reduction of the inclination acceleration error can be achieved.

Furthermore, although the DFT method or the like and the step track method or the like have been used for the detection of the frequency and amplitude of the inclination and the parameter control, other methods such as mean square method, mean absolute value method or zero-crossing method can be also used. In the mean square method, a mean square value of the input signals (an output $\theta_0$ or the like) is obtained, and based on the obtained mean square value, the feedback gain factor $K_b$ is determined. In the mean absolute value method, a mean value of absolute values of the input signals, and on the basis of the obtained mean value, the feedback gain factor $K_b$ is determined. In the zero-crossing method, from a zero-cross of the input signal, its frequency is obtained, and the correction factor $\alpha$ is determined. The mean square method, the mean absolute value method and the zero-crossing method are already known, and thus the detail of these methods can be omitted.

As described above, according to the present invention, by setting the feedback gain factor $K_b$, the offset error can be reduced, and by introducing the correction factor $\alpha$ and its adaptive control, the inclination acceleration error can be reduced.

Furthermore, in addition to the adaptive control of the correction factor $\alpha$, by enlarging the feedback gain factor $K_b$, the drift error can be reduced.

What is claimed is:

1. A stabilized antenna system, comprising:

an antenna, having a fan beam directivity, mounted on a moving platform;

an elevation axis for supporting the antenna rotatably;
an azimuth frame for pivotally supporting the elevation axis;
an azimuth axis for supporting the azimuth frame;
first driving means for controlling the elevation axis to steer the antenna around the elevation axis;
second driving means for controlling the azimuth frame to steer the antenna around the azimuth axis;
inclination sensing means for detecting an inclination angle of the moving platform around the elevation axis, the inclination sensing means being mounted to and rotating together with the azimuth frame, wherein the inclination sensing means includes:
a rate sensor for detecting an angular velocity around the elevation axis;
an inclinometer for detecting an inclination around the elevation axis; and
a reciprocal combination filter for combining outputs of the rate sensor and the inclinometer and outputting an inclination angle around the elevation axis,
the reciprocal combination filter including:
first filter means for filtering the output of the rate sensor;
second filter means having a reciprocal transfer function with reference to the first filter means for filtering the output of the inclinometer; and
adding means for combining outputs of the first and second filter means to output the inclination angle around the elevation axis; and
control means for controlling an attitude of the antenna for tracking a satellite and stabilizing the antenna with reference to the inclination of the moving platform, the control means controlling the first and second driving means to carry out the tracking of the satellite, and controlling the first driving means to control the elevation axis of the antenna for compensating the inclination angle detected by the inclination sensing means.

2. The system of claim 1, wherein the inclination sensing means further includes parameter adaptive control means for adaptively controlling parameters of the reciprocal combination filter depending on a frequency of the inclination,
the first filter means including a feedback loop of a feedback gain factor $K_b$,
the second filter means having a transfer function including a term of the 1st order of Laplace operator s in a numerator,
the parameter adaptive control means including:
means for detecting the frequency of the inclination; and
correction means for determining a correction factor $\alpha(\alpha \leqq 1)$ depending on the detected frequency and correcting the term of the 1st order of Laplace operator s by the correction factor $\alpha$.

3. The system of claim 2, wherein the parameter adaptive control means further includes:
means for detecting an amplitude of the inclination; and
means for determining the feedback gain factor $K_b$ depending on the detected amplitude and for adaptively controlling the feedback gain factor $K_b$.

4. A stabilized antenna system, comprising:
an antenna mounted on a moving platform, the antenna having a fan beam directivity and having an electronic beam steering means to stabilize the beam around an elevation;
an elevation axis for supporting the antenna rotatably;
an azimuth frame for pivotally supporting the elevation axis;
an azimuth axis for supporting the azimuth frame;
first driving means for controlling the elevation axis to steer the antenna around the elevation axis;
second driving means for controlling the azimuth frame to steer the antenna around the azimuth axis;
inclination sensing means for detecting an inclination angle of the moving platform around the elevation axis, the inclination sensing means being mounted to and pivoting together with the azimuth frame, wherein the inclination sensing means includes:
a rate sensor for detecting an angular velocity around the elevation axis;
in inclinometer for detecting an inclination around the elevation axis; and
a reciprocal combination filter for combining outputs of the rate sensor and the inclinometer and outputting an inclination angle around the elevation axis,
the reciprocal combination filter including:
first filter means for filtering the output of the rate sensor;
second filter means having a reciprocal transfer function with reference to the first filter means for filtering the output of the inclinometer; and
adding means for combining outputs of the first and second filter means to output the inclination angle around the elevation axis; and
control means for controlling an attitude and the beam position of the antenna for tracking a satellite and stabilizing the antenna with reference to the inclination of the moving platform, the control means controlling the first and second driving means to carry out the tracking of the satellite, and controlling the beam position of the antenna for compensating the inclination angle detected by the inclination sensing means.

5. The system of claim 4, wherein the inclination sensing means further includes parameter adaptive control means for adaptively controlling parameters of the reciprocal combination filter depending on a frequency of the inclination,
the first filter means including a feedback loop of a feedback gain factor $K_b$,
the second filter means having a transfer function including a term of the 1st order of Laplace operator s in a numerator,
the parameter adaptive control means including:
means for detecting the frequency of the inclination; and
correction means for determining a correction factor $\alpha(\alpha \leqq 1)$ depending on the detected frequency and correcting the term of the 1st order of Laplace operator s by the correction factor $\alpha$.

6. The system of claim 5, wherein the parameter adaptive control means further includes:
means for detecting an amplitude of the inclination; and
means for determining the feedback gain factor $K_b$ depending on the detected amplitude and for adaptively controlling the feedback gain factor $K_b$.

7. An inclination angle detecting device for use in a stabilized antenna system to be mounted on a moving platform, comprising:
a rate sensor for detecting an angular velocity around an elevation axis of the moving platform;
an inclinometer for detecting an inclination around the elevation axis of the moving platform;

a reciprocal combination filter for combining outputs of the rate sensor and the inclinometer and outputting an inclination angle around the elevation axis; and parameter adaptive control means for adaptively controlling parameters of the reciprocal combination filter depending on a frequency of the inclination, the reciprocal combination filter including:

first filter means for filtering the output of the rate sensor, the first filter means including a feedback loop of a feedback gain factor $K_b$;

second filter means for filtering the output of the inclinometer, the second filter means having a reciprocal transfer function including a term of 1st order of Laplace operator s in a numerator with reference to the first filter means; and adding means for combining outputs of the first and second filter means to output the inclination angle around the elevation, the parameter adaptive control means including:

means for detecting the frequency of the inclination; and correction means for determining a correction factor $\alpha(\alpha \leqq 1)$ depending on the detected frequency and correcting the term of 1st order of Laplace operator s by the correction factor $\alpha$ to properly control the correction factor $\alpha$.

8. The system of claim 7, wherein the parameter adaptive control means further includes:

means for detecting an amplitude of the inclination; and means for determining the feedback gain factor $K_b$ depending on the detected amplitude and for adaptively controlling the feedback gain factor $K_b$.

* * * * *